US005565046A

United States Patent [19]

Crafton et al.

[11] Patent Number: 5,565,046

[45] Date of Patent: Oct. 15, 1996

[54] HEAT TREATMENT OF METAL CASTINGS AND INTEGRATED SAND RECLAMATION

[75] Inventors: Scott P. Crafton, Ossingen, Switzerland; Paul M. Crafton, Jr., Kennesaw, Ga.

[73] Assignee: Consolidated Engineering Company, Inc., Kennesaw, Ga.

[21] Appl. No.: 419,372

[22] Filed: Apr. 10, 1995

Related U.S. Application Data

[63] Continuation of Ser. No. 283,958, Aug. 1, 1994, abandoned, which is a continuation of Ser. No. 198,879, Feb. 18, 1994, Pat. No. 5,354,038, which is a continuation of Ser. No. 930,193, Aug. 13, 1992, abandoned, which is a continuation-in-part of Ser. No. 705,626, May 24, 1991, abandoned, which is a continuation-in-part of Ser. No. 415,135, Sep. 29, 1989, abandoned.

[51] Int. Cl.[6] ..... B22C 13/02

[52] U.S. Cl. ..... 148/538; 266/252

[58] Field of Search ..... 266/249, 252, 266/44; 148/538, 540, 543; 164/269, 270.1

[56] References Cited

U.S. PATENT DOCUMENTS

| | | | |
|---|---|---|---|
| 2,385,962 | 10/1945 | Barnett | 34/13 |
| 2,813,318 | 11/1957 | Horth | 22/89 |
| 2,988,351 | 6/1961 | Barnett et al. | 263/40 |
| 3,534,946 | 10/1970 | Westerkamp et al. | 263/28 |
| 3,737,280 | 6/1973 | Cromp | 432/41 |
| 3,871,438 | 3/1975 | Vissers et al. | 164/5 |
| 4,140,467 | 2/1979 | Ellison et al. | 432/72 |
| 4,211,274 | 7/1980 | Slowinski et al. | 164/401 |
| 4,242,077 | 12/1980 | Hyre | 431/19 |
| 4,294,436 | 10/1981 | Takahashi | 266/257 |
| 4,340,433 | 7/1982 | Harding | 148/16 |
| 4,392,814 | 7/1983 | Harding | 431/170 |
| 4,411,709 | 10/1983 | Nakanishi | 148/3 |
| 4,415,444 | 11/1983 | Guptail | 209/3 |
| 4,457,352 | 7/1984 | Scheffer | 164/5 |
| 4,478,572 | 10/1984 | Selli | 432/13 |
| 4,544,013 | 10/1985 | Kearrey et al. | 164/5 |
| 4,563,151 | 1/1986 | Vogel | 432/15 |
| 4,577,671 | 3/1986 | Stephan | 164/401 |
| 4,579,319 | 4/1986 | Sasaki | 266/252 |
| 4,582,301 | 4/1986 | Wünning | 266/87 |
| 4,604,055 | 8/1986 | Mackenzie | 432/58 |
| 4,620,586 | 11/1986 | Musschoot | 164/253 |
| 4,648,836 | 3/1987 | Thorn | 432/107 |
| 4,700,766 | 10/1987 | Godderidge | 164/5 |
| 4,830,605 | 5/1989 | Hodate et al. | 431/170 |
| 4,955,425 | 9/1990 | McKenna | 164/269 |
| 5,253,698 | 10/1993 | Keough et al. | 164/269 |
| 5,294,094 | 3/1994 | Crafton et al. | 266/44 |
| 5,350,160 | 9/1994 | Crafton et al. | 266/252 |
| 5,354,038 | 10/1994 | Crafton | 266/44 |

FOREIGN PATENT DOCUMENTS

| | | | |
|---|---|---|---|
| 1197981 | 12/1985 | Canada . | |
| 2307773 | 2/1973 | Germany . | |
| 2914221 | 4/1979 | Germany . | |
| 3206048 | 2/1982 | Germany . | |
| 4012158 | of 1989 | Germany | 164/5 |
| 56-53867 | 5/1981 | Japan . | |
| 5939464 | 8/1982 | Japan . | |
| 58-25860 | 2/1983 | Japan . | |
| 59-219410 | 12/1984 | Japan . | |
| 60-92040 | 5/1985 | Japan | 164/132 |
| 2074022 | 9/1985 | Japan . | |
| 63-16853 | 1/1988 | Japan | 164/132 |
| 1129012 | 7/1982 | U.S.S.R. . | |
| 0234810 | 3/1985 | U.S.S.R. | 164/132 |
| 2230720 | 10/1990 | United Kingdom . | |

OTHER PUBLICATIONS

The Specification and Figures of Serial No. 07/705,626 Jul. 30, 1991.

Economical Used Energy Type Continuing Heat Treating Furnace For Aluminum Castings–Kogyo–Kanetsu vol. 21 No. 2 pp. 29–36–Published Mar. 1984.

Brochures Describing Beardsley & Pipe PNEU–Rellaim Sand Reclamation Units Sep. 1994.

Brochure Describing Fataluminium Sand Reclamation Units Sep. 1994.

Paul M. Crafton–Heat Treating Aging System Also Permits Core Sand Removal–Reprinted from Sep. 1989–Modern Casting Magazine.

Preliminary Remarks Dated Jul. 30, 1991 and Filed in Ser. No. 07/705,626.

Declaration by P. M. Crafton and S. P. Crafton Dated Jul. 26, 1991, and Filed in Ser. #07/705,626.
Sales Brochure Describing Thermfire Brand Sand Reclamation, Gudgeon Brothers, Ltd., Believed to be Known by Others Prior to Sep. 1989.
Sales Brochure Describing Simplicity/Richards Gas–Fired Thermal Reclamation System, Simplicity Engineering, Inc., Believed to be Known by Others Prior to Sep. 1989.
Sales Brochure Describing Air Trac Brand Fluidizing Conveyor, Air Trac Systems Corp., Believed to be Known by Others Prior to Sep. 1989.
Sales Brochure Describing Fluid Bed Calcifier Therman Sand Reclamation Systems, Dependable Foundry Equipment Co., Inc., Believed to be Known by Others Prior to Sep. 1989.

*Primary Examiner*—Scott Kastler
*Attorney, Agent, or Firm*—Louis T. Isaf, P.C.

[57] ABSTRACT

The method and apparatus for reclaiming substantially pure sand from a heat treating furnace; wherein a casting with sand core and/or sand mold, comprising sand bound by a combustible binder, attached thereto is introduced into the heat treating furnace; or, wherein portions of sand core and/or sand mold that are not attached to a casting are introduced into the heat treating furnace. Wherein, the reclaiming within the furnace is carried out, in part, by a fluidizer that promotes binder combustion by one or more process of agitating, heating, and oxygenating. Wherein, the characteristics of the reclaimed sand are selectively controlled by controlling the dwell time of the sand within the heat treating furnace.

89 Claims, 15 Drawing Sheets

HEAT TREATMENT OF METAL CASTINGS AND INTEGRATED SAND RECLAMATION

This application is a continuation application of Ser. No. 08/283,958, filed on Aug. 1, 1994 now abandoned, which is a continuation application of Ser. No. 08/198,879, filed Feb. 18, 1994, now U.S. Pat. No. 5,354,038, which is a continuation application of Ser. No. 07/930,193, filed Aug. 13, 1992, now abandoned, which is a continuation-in-part application of Ser. No. 07/705,626, filed May 24, 1991, now abandoned, which is a continuation-in-part application of Ser. No. 07/415,135, filed Sep. 29, 1989, now abandoned.

BACKGROUND OF THE INVENTION

The present invention relates generally to the field of heat treating metal castings and the field of reclaiming sand from sand cores and sand molds used to make metal castings.

Generally, prior art methods and apparatus require that two or three distinctly separate steps be taken in order to heat treat a metal casting formed by a permanent mold or sand mold with a sand core, and reclaim sufficiently pure sand from the sand mold or sand core. The present invention allows for heat treating and reclamation of sufficiently pure sand in a single step.

Methods and apparatus for manufacturing metal castings are well known. Molds and cores are used to displace molten material so that when the molten material is solidified, a casting is formed that reflects the features of the mold and core. Molds have the exterior features of the casting formed on the interior walls of the mold and cores have the interior features of the casting formed on the exterior surface of the core. The cores are typically made from sand whereas the molds are sometimes made from sand. Sand molds and cores are typically pre-molded from a mixture of sand and a combustible binder. For simplicity, sand molds and sand cores are referred to hereafter as simply sand cores.

In accordance with some of the prior art, once the casting is formed, three distinctly different steps are carried out in order to heat treat the metal casting and reclaim sufficiently pure sand from the sand core. The first step separates portions of sand core from the casting. The sand core is typically separated from the casting by one or a combination of means. For example, sand may be chiseled away from the casting or the casting may be physically shaken to break-up the sand core and remove the sand. Once the sand is removed from the casting, the second and third steps are carried out. In this typical, three-step prior art, the order in which the second and third steps are taken is not important, since the sand has already been separated from the casting. The second step consists of heat treating the casting. The casting is typically heat treated if it is desirable to strengthen or harden the casting. The third step consists of purifying the sand that was separated from the casting. The purification processes is typically carried out by one or a combination of means. These may include burning the binder that coats the sand, abrading the sand, and passing portions of the sand through screens. It is important that the reclaimed sand be sufficiently pure in order for it to be properly reused in the construction of new sand cores. It is also helpful if the reclaimed sand is rounded, at least to some degree, so as to assist in the casting of smooth surfaces and to assist in good bonding of the sand grains which causes strong cores. Therefore, portions of sand may be re-subjected to reclaiming processes until sufficiently pure sand is reclaimed.

The purity of the reclaimed sand can be measured in terms of the quantity of unburned binder. The less unburned binder, the more pure the sand. While seeking increased purity, some sand is reduced to "fines". Fines is the term used for sand particles smaller than a specified size. Fines are so small that they require excessive amounts of binder. These two measures (purity and fines) generally oppose each other in that the higher the measure of one, the lower the measure of the other. It is important to balance these measures; therefore, it is important that the sand reclaiming processes be capable of controlling these measures.

In accordance with the present inventor's previous invention disclosure of U.S. Pat. No. 5,294,094, only one step need be taken in order to heat treat metal castings formed by sand cores and reclaim sand from the sand cores. This is carried out by introducing the castings, with the sand cores attached thereto, into a furnace with an oxygenated atmosphere that is heated to at least the combustion temperature of the sand core binder material. This causes combustion of some of the binder of the sand core which, in combination with other means, causes the sand core to separate from the casting. The system disclosed in U.S. Pat. No. 5,294,094 promotes more binder combustion than is required to separate the sand core from the casting. The system disclosed in U.S. Pat. No. 5,294,094 ejects sand from the furnace in a sufficiently pure state for some applications; but, that system is not capable of combusting a sufficient amount of binder (or otherwise processing the sand core) so as to render sand that is sufficiently pure for certain other applications. Also, that system does not make provisions for varying the characteristics of the reclaimed sand; no selective control over sand roundness, amount of fines, or amount of unburned binder in the reclaimed sand is possible. Therefore, the sand reclaimed using the method and apparatus disclosed in U.S. Pat. No. 5,294,094 may require further processing in order to obtain sand that is sufficiently pure for certain applications or sand that has certain characteristics. Therefore, previous sand reclaiming systems are inherently inefficient in that they require at least a two step process, carried out in two separate venues by separate, specialized equipment, in order to heat treat a metal casting formed by a sand core and reclaim sufficiently pure sand from the sand core.

There is a need, therefore, for a more efficient method, and associated apparatus, that allows for more efficient heat treatment, sand core removal, and reclamation of sufficiently pure sand from the sand core.

SUMMARY OF THE INVENTION

Briefly described, the present invention provides an improved method and apparatus for heat treating metal castings that are manufactured using sand cores and for reclaiming sand from the sand cores. More specifically, the present invention provides an improved method and apparatus for collecting sand within a heat treating furnace, purifying the sand, and ejecting the sand from the furnace. The present invention can reclaim sand that is more pure than that typically extracted from heat treating furnaces. The method and apparatus of the present invention also allows for selective control over the amount of binder and fines in the sand ejected from the furnace.

The preferred embodiment of the present invention includes, associated with a furnace, apparatus for agitating sand which has been collected within the furnace. In the preferred embodiment, this agitation apparatus utilizes pressurized air to accomplish the agitating function through a process of "fluidization", and shall be referred to herein as a fluidizer. This fluidization process passes air, from a pressurized source, through sand collected in the furnace causing portions of the sand to be suspended and act like a turbulent fluid. The fluidizer, in conjunction with other components in the furnace, causes the binder portion of sand cores to sufficiently combust within the furnace so that sufficiently pure sand is reclaimed. In this embodiment, the sand cores, from which binder is combusted, are attached to the castings that are transported into the furnace. A preferred furnace embodiment, and some of the elements within the furnace are disclosed in U.S. Pat. No. 5,294,094. The fluidizer and some of the elements associated with it are disclosed for the first time in this application.

The fluidizer of the preferred embodiment of the present invention causes the fluidization of sand that has collected within the furnace hopper. The fluidizing causes portions of sand to abrade against one another, and in at least one embodiment, to also abrade against a metal target, in a manner that exposes the binder. The exposed binder then combusts. The process is repeated until a sufficient amount of binder has been combusted to satisfy the user as to the purity of the sand.

In the preferred embodiment of the present invention, the fluidizer adds oxygen to the furnace hopper so as to promote binder combustion. In one preferred embodiment of the present invention, the fluidizer is supplied with preheated air from a secondary heat source so as to further promote binder combustion. In an alternate, preferred embodiment, the air of the fluidizer is not pre-heated. In accordance with one aspect of the present invention, multiple fluidizers are employed, and, in such embodiment, appropriate fluidizer embodiments are chosen and selectively placed along a multiple zoned furnace.

The present invention further includes methods and apparatus for discharging reclaimed sand from the furnace. In the preferred embodiment of the present invention, this discharging is controlled so as to control the volume of sand contained in the furnace. This affects the amount of time that sand is subjected to the fluidizing, thus effecting a control over the characteristics of the reclaimed sand.

An alternate embodiment of the present invention includes a supplemental sand reclamation unit (the "SSRU"). The supplemental sand reclamation unit, which functions in conjunction with the furnace heat source and in conjunction with the fluidizer and other components in the furnace, provides supplemental reclamation of sand previously reclaimed from casting cores. For example, sand collected from prior art shakers and sand discharged from the troughs of the furnace of U.S. Pat. No. 5,294,094 is reprocessed by the supplemental sand reclamation unit. The supplemental sand reclamation unit includes a bin that is outside of the furnace. A tube is connected to a bin outlet and passes into the furnace. The tube passes, within the furnace, in close proximity to furnace heaters and terminates toward the furnace hopper. Collected sand is deposited into the bin where it is heated to above the binder combustion temperature and exposed to an oxygen-rich atmosphere; this causes an initial binder combustion. The sand then enters the tube. While passing through the tube, the sand is heated by the furnace heaters and further binder combustion occurs. When the sand exits the tube it falls into the furnace where it is, preferably, further purified by the in-furnace sand reclamation unit of the present invention.

It is, therefore, an object of the present invention to provide an improved method and apparatus for heat treating castings, with sand core material attached thereto, and reclaiming sand from the sand core material.

Another object of the present invention is to provide an improved method and apparatus for removing sand core material from a casting and reclaiming sand from the sand core material.

Another object of the present invention is to provide a method and apparatus for reclaiming, within a furnace, sand from portions of sand core that are separated from castings within the furnace.

Another object of the present invention is to provide a method and apparatus for agitating, within a furnace, sand that is collected within the furnace.

Another object of the present invention is to provide a method and apparatus for fluidizing, within a furnace, sand that is collected within the furnace.

Another object of the present invention is to provide a method and apparatus for enhancing combustion, within a heat treating furnace, of binder that coats sand that is collected in the furnace.

Another object of the present invention is to provide a method and apparatus for heating, from a secondary source, sand that is collected within a furnace.

Another object of the present invention is to provide a method and apparatus for providing oxygen to the area in which sand is collected within a furnace.

Another object of the present invention is to provide a method and apparatus for reclaiming sand outside of the furnace, and purifying the reclaimed sand within a furnace.

Yet another object of the present invention is to provide a method and apparatus for controlling the amount of time that sand core material is exposed to sand reclamation processing within a furnace so that the characteristics of the reclaimed sand can be controlled.

Other objects, features and advantages of the present invention will become apparent upon reading and understanding this specification, taken in conjunction with the accompanying drawings.

DETAILED DESCRIPTION OF THE PREFERRED EMBODIMENT

This section of the specification consists of two parts. The first part introduces components and describes their orientation and interconnections. The second part describes the operation of the components and provides some examples of acceptable components.

Figure 1:
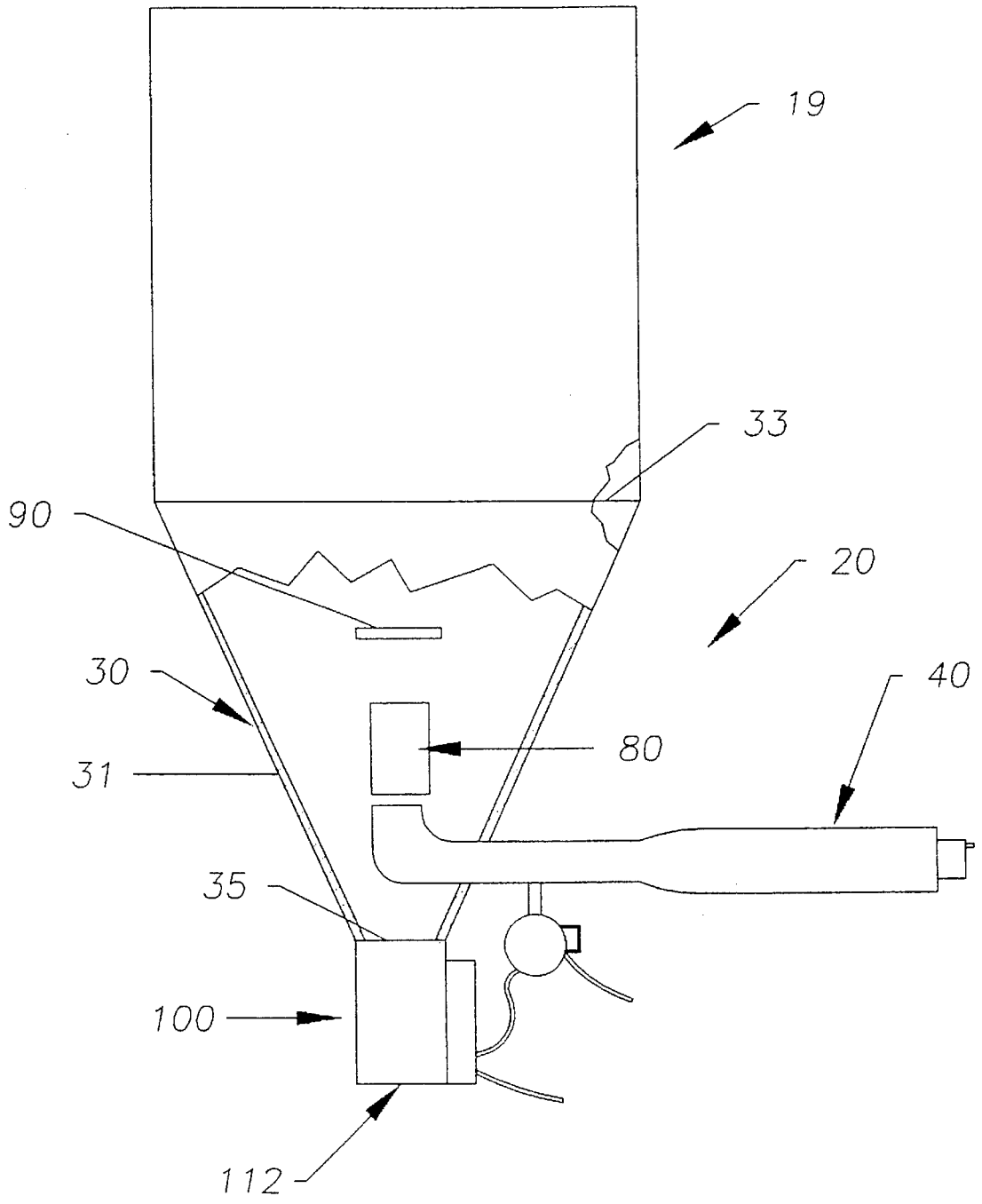
FIG. 1 is a cut-away view of a combination heat treating furnace and in-furnace sand reclamation unit, in accordance with the preferred embodiment of the present invention.

Referring now in greater detail to the drawings, in which like numerals represent like components throughout the several views, FIG. 1 shows a partially cut-away view of a combination heat treating furnace 19 and in-furnace sand reclamation unit 20, in accordance with the preferred embodiment of the present invention. The in-furnace sand reclamation unit 20 includes a hopper 30 which has a hopper wall 31 and defines a hopper inlet 33 and a hopper outlet 35. A portion of the hopper wall 31 and other elements are cut-away in FIG. 1 so that elements shown can be clearly seen. The in-furnace sand reclamation unit 20 further includes a fluidizer 40, guidance tube 80, abrasion disk 90 and a discharge valve assembly 100. The fluidizer 40 is shown passing through the hopper wall 31. The guidance tube 80 is shown oriented above the fluidizer within the hopper 30. The abrasion disk 90 is shown oriented above the guidance tube 80 within the hopper 30. The discharge valve assembly 100 is shown connected to the hopper outlet 35. In the preferred embodiment of the present invention, the hopper 30 of the in-furnace sand reclamation unit 20 doubles as the hopper 30 of the heat treating furnace 19. An appropriate heat treating furnace 19 is disclosed in U.S. Pat. No. 5,294,094. The specification of U.S. patent application Ser. No. 07/705,626 is hereby incorporated herein by reference. The discharge valve assembly 100 provides a path to the outside of the furnace.

Figure 2:
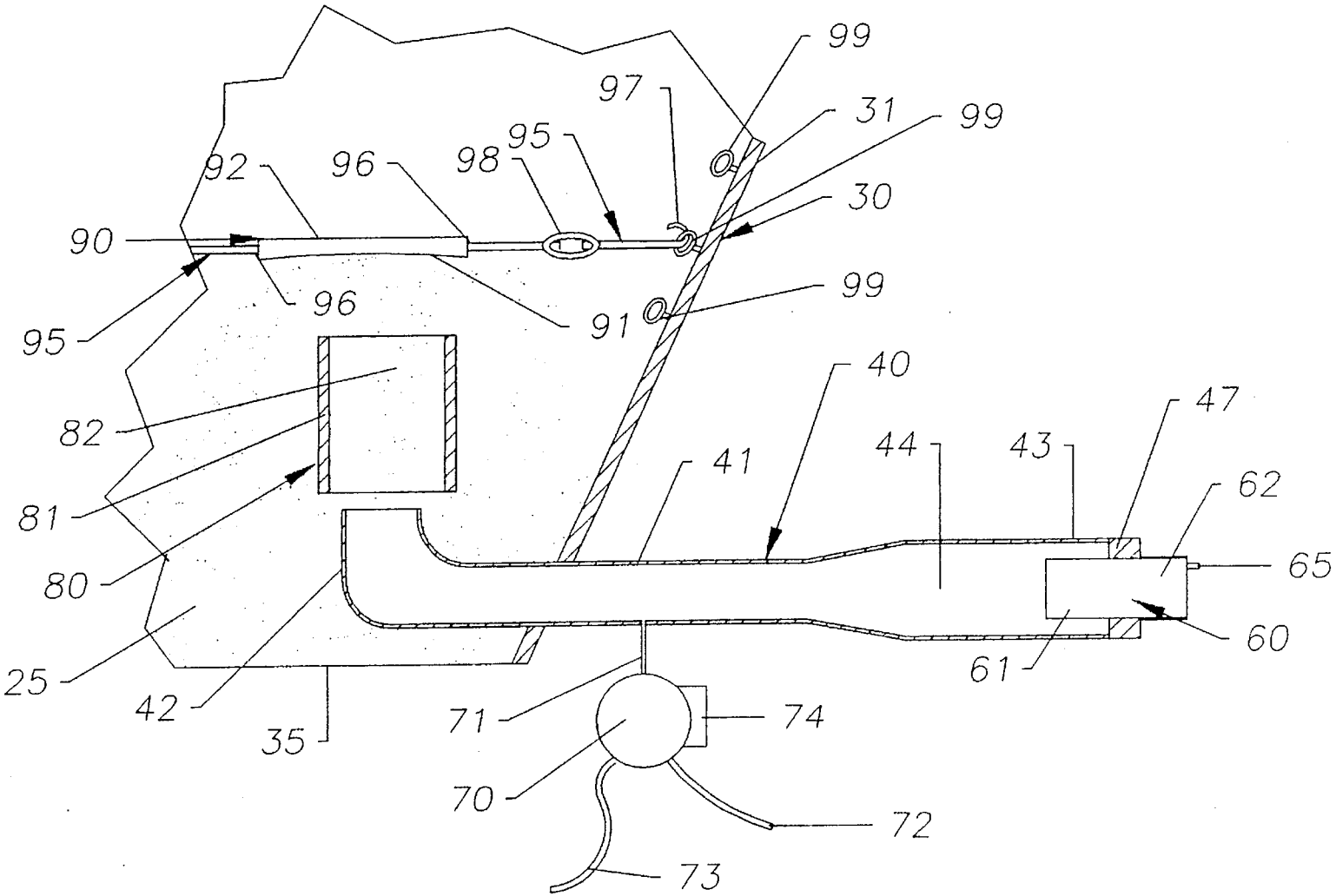
FIG. 2 is a cut-away view of selected elements of the sand reclamation unit of FIG. 1.

FIG. 2, which is a cut-away side view of selected elements of FIG. 1, shows the fluidizer 40 of the preferred embodiment of the present invention, in greater detail. Sand 25 is also shown, in representative form, collected at the hopper outlet 35. The fluidizer 40 is seen as including a fluidizer conduit 41; the fluidizer conduit 41 has a fluidizing end 42 that is within the lopper 30 and a source end 43 that is outside of the hopper 30. A portion of the fluidizer conduit 41 has been cut-away to expose a conduit interior 44 which is defined by the fluidizing conduit 41. The source end 43 of the fluidizer conduit 41 is sealed by an end plate 47. The end plate 47 is attached to the source end 43 in a manner that would be understood by those reasonably skilled in the industry; for example, by welding. A portion of the end plate 47 is cut away in FIG. 2, to fully expose a heater 60. The heater 60 is secured through the end plate 47 in a manner that facilitates removal for repair or replacement with a different type of heater. The heater 60 has an exhaust end 61 located within the conduit interior 44 and an intake end 62 outside of the fluidizer conduit 41. Pressurized air is supplied into the intake end 62 of the heater 60 through an air intake 65. In the preferred embodiment of the present invention, the heater 60 is a high pressure gas burner. In an alternate embodiment of the present invention, the heater 60 consists of an electric heating element. Other heater types are acceptable.

A signal generating pressure gauge 70 is connected to the fluidizer conduit 41 by a gauge conduit 71. This connection is such that the signal generating pressure gauge 70 is in communication with the conduit interior 44 and can sense the pressure within the fluidizer conduit 41. A signal adjuster 74 is associated with the signal generating pressure gauge 70. The signal generating pressure gauge 70 is connected to an electric power supply by a gauge power cable 72. The signal generating pressure gauge 70 is connected by a signal cable 73 to the discharge valve assembly 100, which is not shown in FIG. 2.

The fluidizer end 42 of the fluidizer conduit 41 is turned upward in FIG. 2 toward a the guidance tube 80 and the abrasion disk 90. The guidance tube 80, part of which is cut away in FIG. 2, has a tube wall 81 and defines a tube passage 82. The abrasion disk 90, part of which is cut away in FIG. 2, has disk back 92 and a concave disk face 91.

Figure 3:
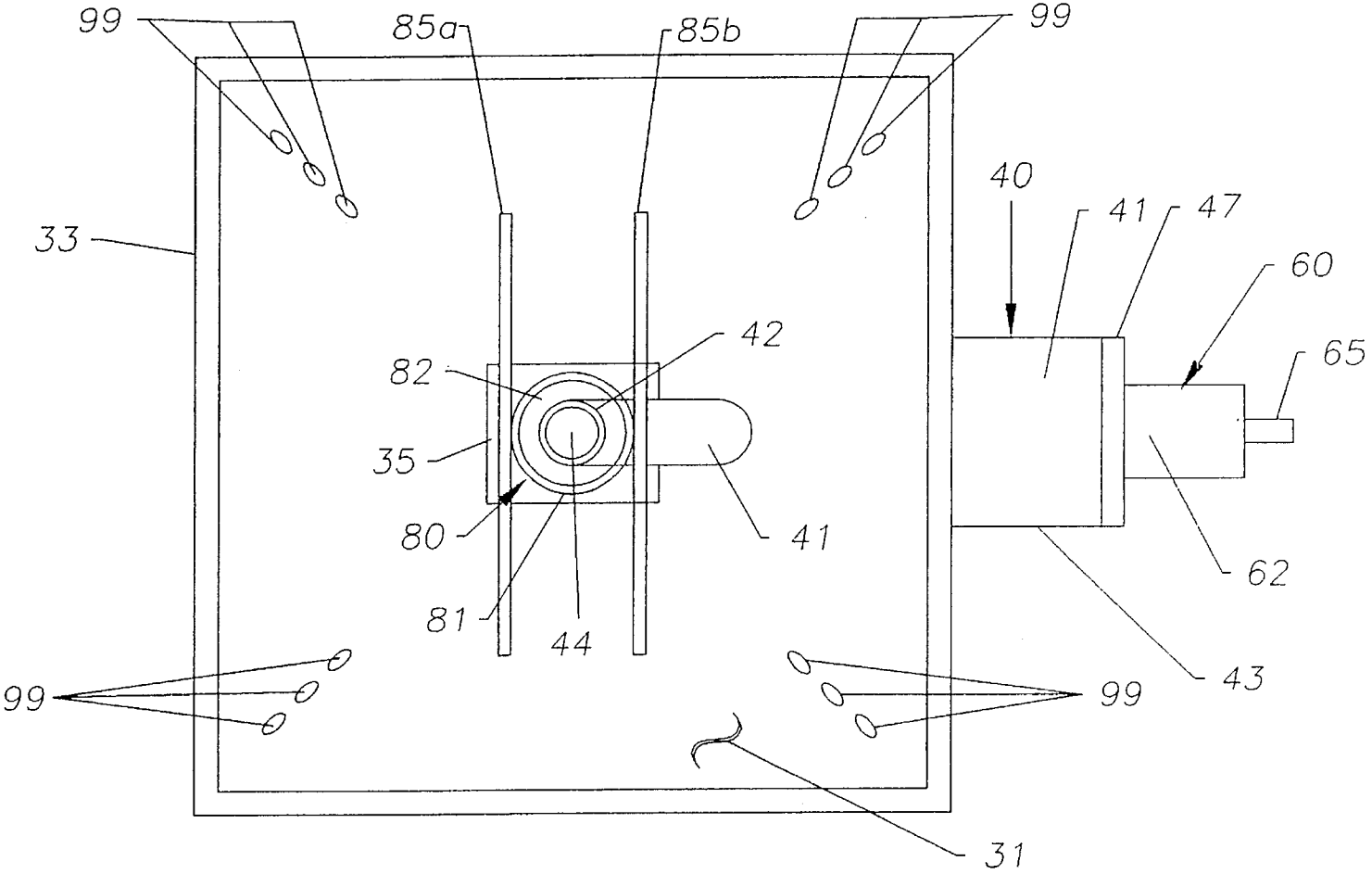
FIG. 3 is a cut-away top view of selected elements of the sand reclamation unit of FIG. 1, showing some of the elements that are cut-away in FIG. 1.

FIG. 3 is a top view of the apparatus of FIG. 2 in greater detail and with the abrasion disk 90 removed. As shown in FIG. 3, the guidance tube 80 is connected to tube support rods 85*a,b* which are connected to the hopper wall 31. These connections are made in a manner as would be understood by those reasonably skilled in the industry; for example, by welding or bolting. The guidance tube 80 is positioned such that the guidance tube 80 is oriented above the fluidizer end 42 of the fluidizer conduit 41 and the tube passage 82 is in-line with the conduit interior 44 at the fluidizer end 42.

Figure 4:
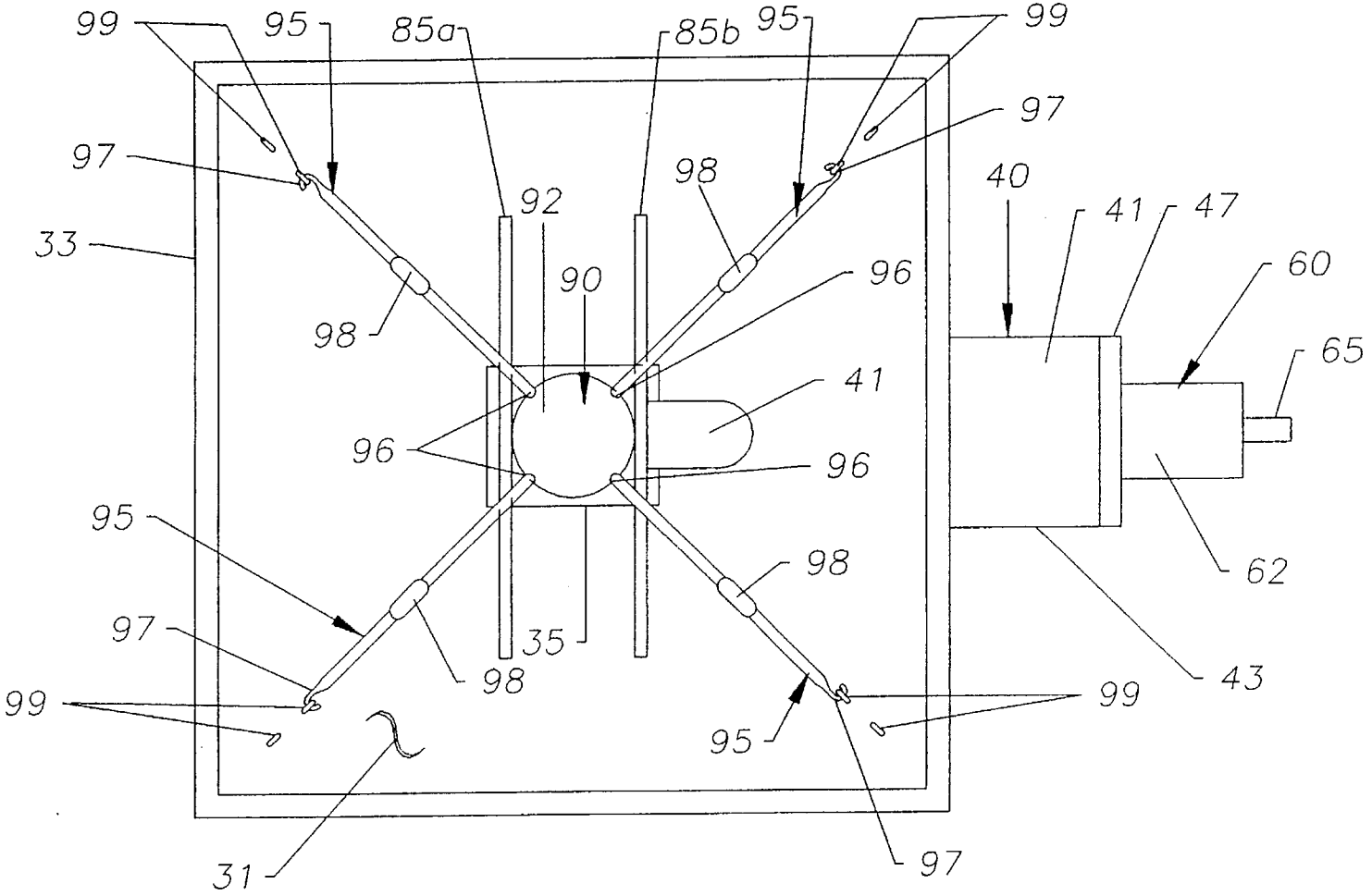
FIG. 4 is a cut-away top view of selected elements of the sand reclamation unit of FIG. 1, showing some of the elements that are cut-away in FIG. 1.

FIG. 4 is a top view of the apparatus of FIG. 2 in greater detail. In FIG. 4 the disk face 91 of the abrasion disk 90 is oriented toward the fluidizer end 42 and is therefore not seen. As seen in FIGS. 2 and 4, the abrasion disk 90 is connected to disk support cables 95 which are attached to the lopper wall 31. The cables 95 have a disk end 96, a hook end 97, and a turnbuckle 98 disposed between the disk end 96 and the hook end 97. The disk ends 96 of the cables 95 are attached to the abrasion disk 90 in a manner that would be understood by those reasonably skilled in the industry; for example, by welding or bolting. The hook end 97 of each cable 95 is attached to the inner hopper wall 31 by an eyehook 99; the hook ends 97 are hooked to eyehooks 99. The eyehooks 99 are connected to the hopper wall 31 in a manner that would be understood by those reasonably skilled in the industry; for example, by welding or bolting. There are a plurality of eyehooks 99, each of which is oriented so that the height of the abrasion disk 90 above the fluidizer end 42 is capable of being adjusted, as will be explained below. The fluidizer end 42, conduit interior 44, and guidance tube 80 are not seen in FIG. 4 because they are concealed by the abrasion disk 90.

Figure 5:
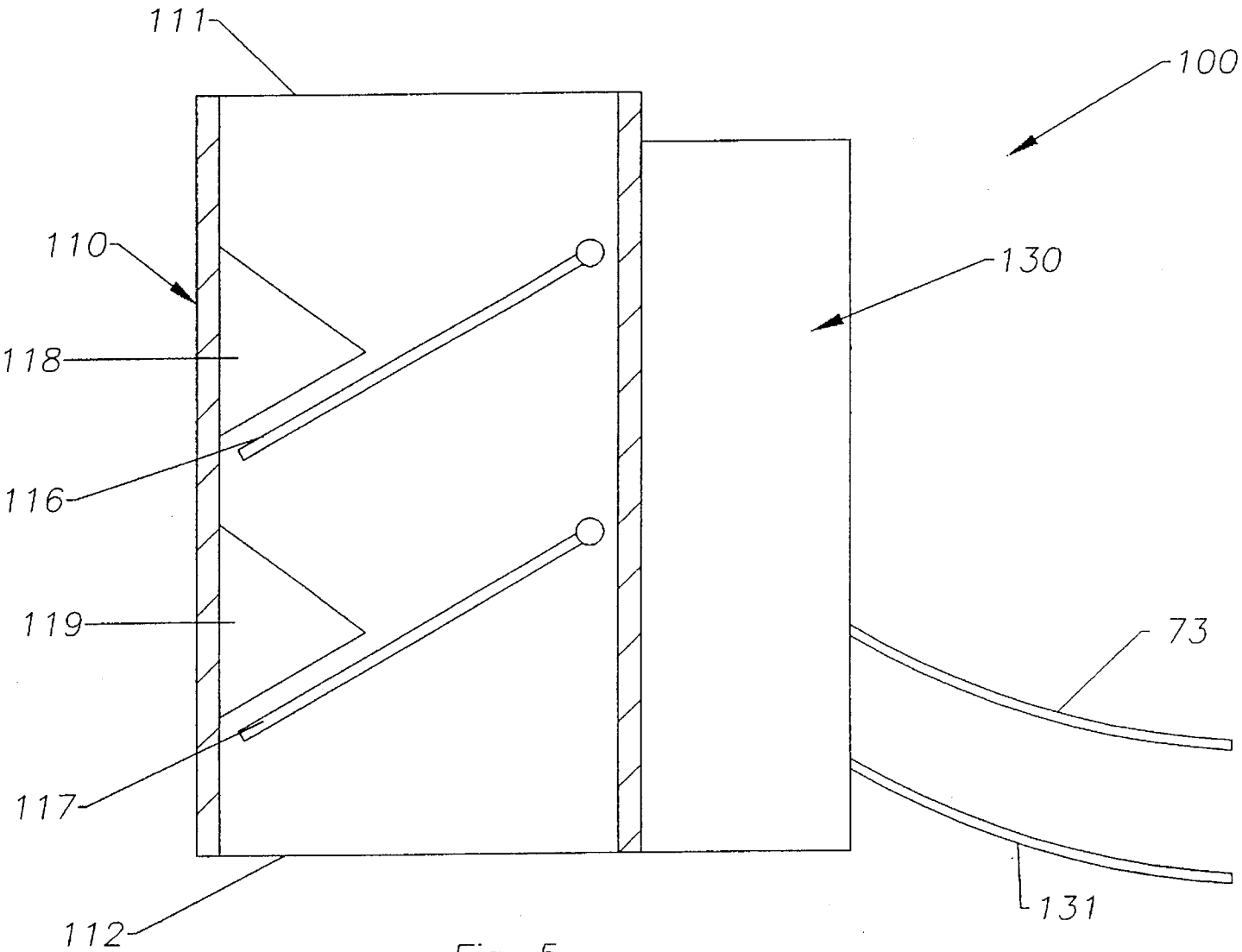
FIG. 5 is a cut-away side view of the discharge valve assembly of FIG. 1.

FIG. 5 is a cut-away side view of the discharge valve assembly shown in FIG. 1. The discharge valve assembly 100 includes a double dump valve 110 and a pneumatic valve operator 130. The double dump valve 110 has a valve inlet 111 and a valve outlet 112. The valve inlet 111 is connected to the hopper outlet 35 (see FIG. 1) in a manner that would be understood by those reasonably skilled in the industry; for example, by welding or bolting. The valve outlet 112 is located outside of the heat treating furnace 19 such that the double dump valve 110 provides a path from within the hopper 30 to the outside of the furnace 19. A portion of the double dump valve 110 is cut away in FIG. 5 to expose a first disk 116, a second disk 117, a first seat 118, and a second seat 119. The pneumatic valve operator 130 is connected to the double dump valve 110, in a manner that is understood by those reasonably skilled in the art, such that the pneumatic valve operator 130 controls the operation of the double dump valve 110. The pneumatic valve operator 130 is connected to a pneumatic supply line 131 and the signal cable 73. In an alternate embodiment of the present invention, the pneumatic valve operator 130 is replaced with an electric, motorized valve operator; hydraulic valve operator; or some other type of valve operator.

Figure 6:
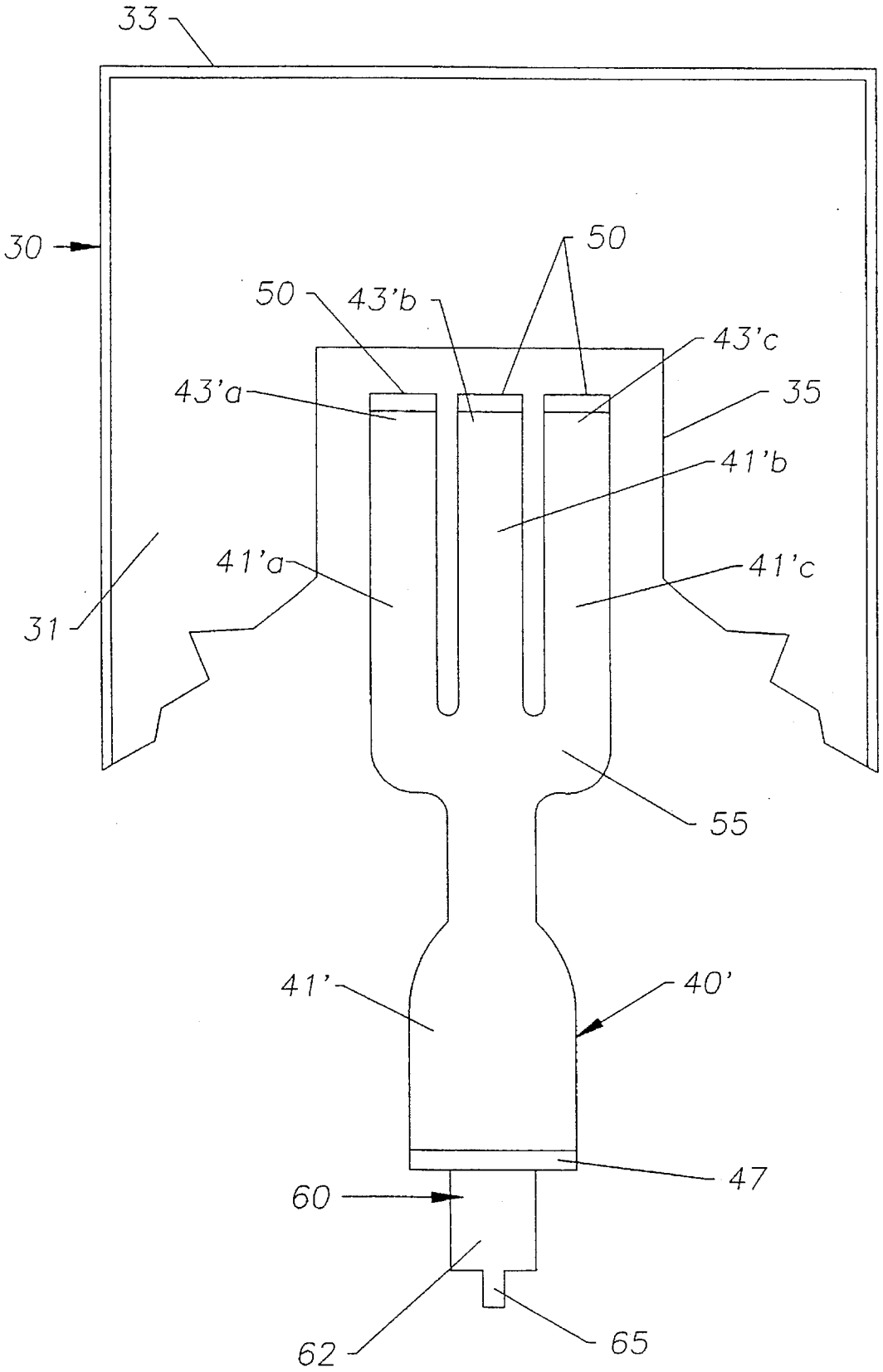
FIG. 6 is a cut-away top view of a portion of an in-furnace sand reclamation unit, in accordance with an alternate, preferred embodiment of the present invention.
Figure 8:
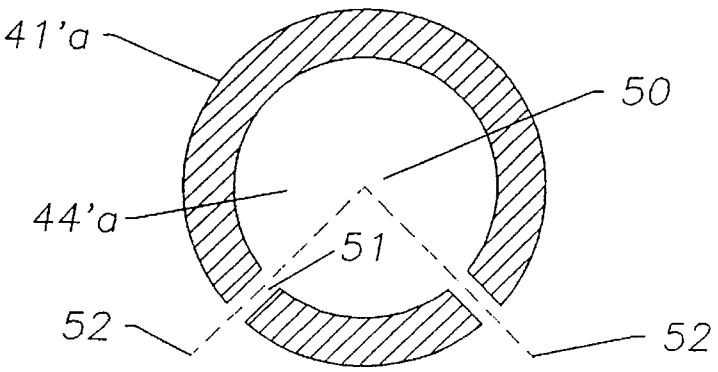
FIG. 8 is a cross-sectional view of the fluidizer conduit of FIG. 6, taken along line 8—8 of FIG. 7.
Figure 7:
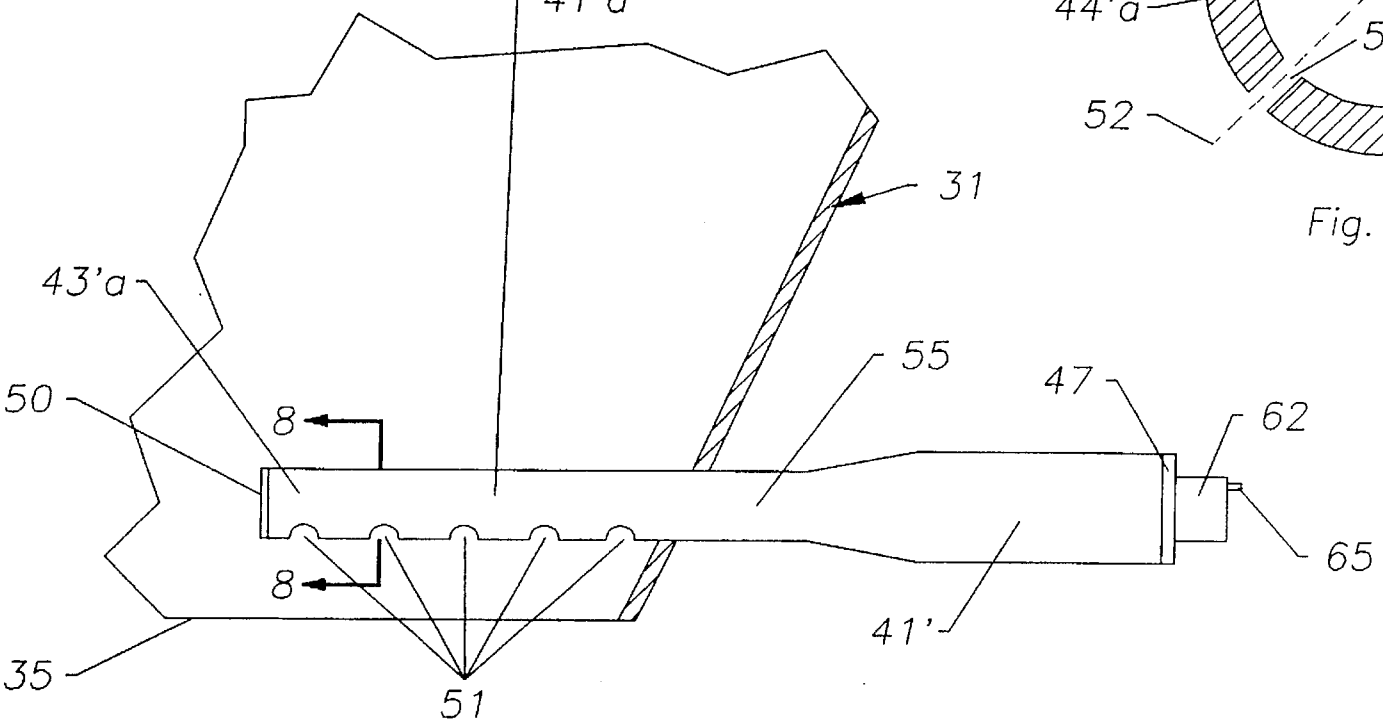
FIG. 7 is a cut-away side view of a portion of the apparatus of FIG. 6.

FIG. 6 and FIG. 7 show an alternate, preferred embodiment of the present invention. FIG. 6 is a cutaway top view of portions of the present invention in accordance with the alternate embodiment. This alternate embodiment does not include the guidance tube 80 or abrasion disk 90. This alternate embodiment does include a fluidizer 40' which is somewhat similar to the fluidizer 40 of the preferred embodiment. However, the fluidizer 40' has a fluidizer conduit 41' that splits into three fluidizer conduits 41'*a,b,c*, each of which pass through the hopper wall 31. The fluidizer conduits 41'*a,b,c* originate from a conduit header 55. The conduit header 55 originates from the source end 43 of the fluidizer conduit 41'. Also, the fluidizer ends 43'*a,b,c* are sealed in a manner that would be understood by those reasonably skilled in the industry; for example, with a plug 50. Also, as is indicated by FIG. 7, which is a side view of the fluidizer 40' showing a portion of the hopper 30, each fluidizer conduit 41'*a,b,c* defines a plurality of fluidizing holes 51 that are oriented toward the hopper outlet 35. (In FIG. 7, two of the fluidizer conduits 41'*a,b,c* are concealed by one of the fluidizer conduits 41'*a*.) FIG. 8 is a cross-sectional view taken along line 8—8 in FIG. 7; only one fluidizer conduit 41'*a* is shown for simplicity; the other conduits 41'*b,c* being similarly constructed. As seen in FIG. 8, the fluidizing holes are in communication with the conduit interior 44'. Also, in the embodiment shown in FIGS. 7 and 8, the fluidizing holes 51 are spaced linearly and radially along the portion of the fluidizer conduit 41'*a* that faces the hopper outlet 35. Preferably, the angle between the centerlines 52 defined by two fluidizing holes 51 that are radially positioned with respect to one another is ninety degrees. In alternate embodiments of the present invention, the fluidizing holes 51 are spaced in a different manner.

Another alternate embodiment of the present invention, which is not shown, is similar to the previously disclosed alternate embodiment of FIGS. 6–8, except that the fluidizer conduit 40 splits into six fluidizer conduits. Three of the six fluidizer conduits penetrate one furnace hopper 30 and the other three of the six fluidizer conduits penetrate a different furnace hopper 30. Actually, there are a variety of alternate embodiments of the present invention that are variations upon those just disclosed. Although not shown in FIGS. 6 and 7, the signal generating pressure gauge 70, with all of its associated elements, is included in these alternate embodiments of the present invention.

Figure 9:
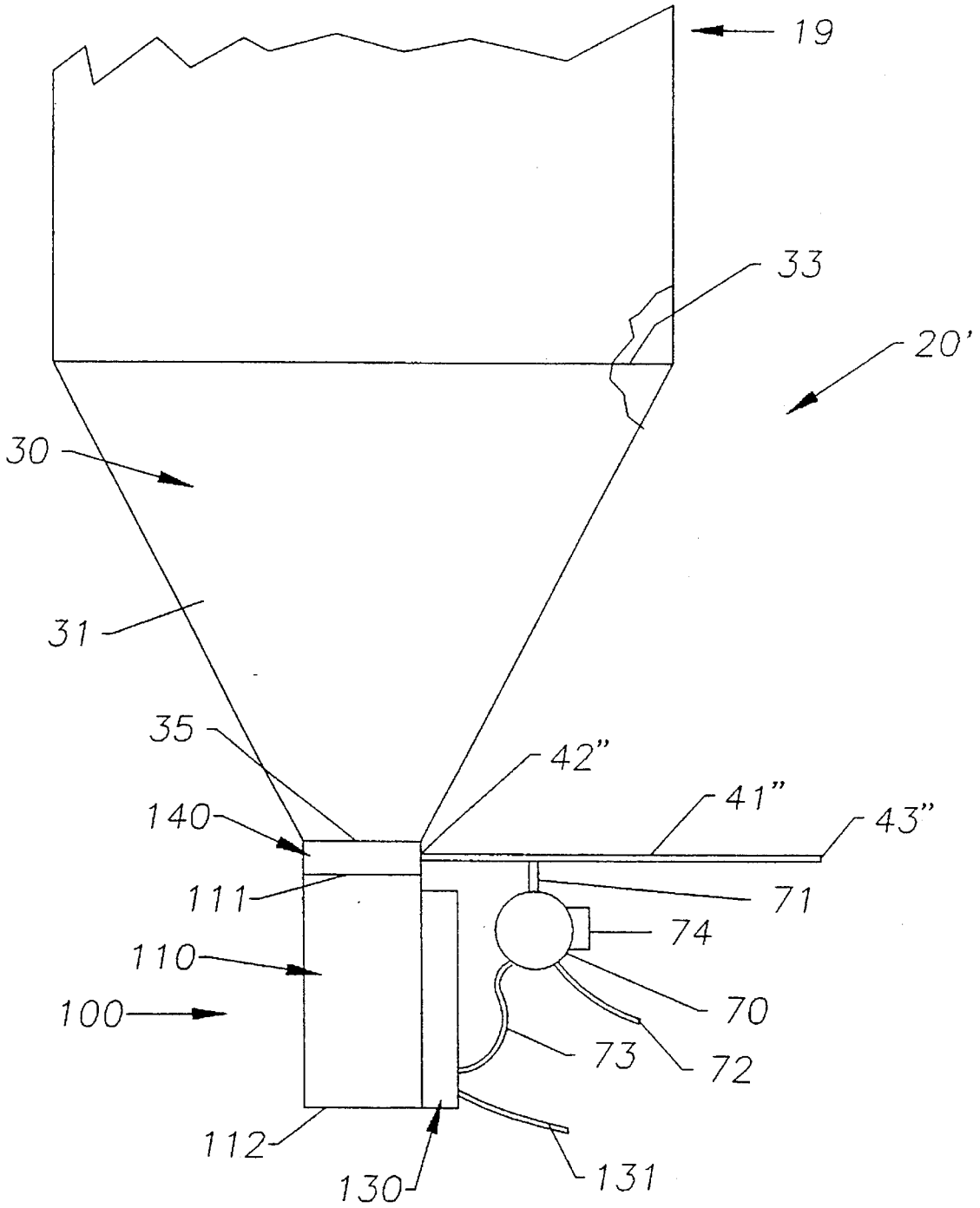
FIG. 9 is a side view of an in-furnace sand reclamation unit, in accordance with an alternate, preferred embodiment of the present invention.

FIG. 9 shows an alternate, preferred embodiment of the present invention which does not include the guidance tube 80 or the abrasion disk 90. In this alternate embodiment, a fluidizing ring 140 is disposed between the hopper outlet 35 and the valve inlet 111. The fluidizing ring 140 is connected to the hopper outlet 35 and the valve inlet 111 in a manner that would be understood by those reasonably skilled in the industry; for example, by welding or bolting. Also shown in FIG. 9 is a fluidizer conduit 41". The fluidizer conduit 41" defines a conduit interior 44" (not shown). The fluidizer conduit 41" has a fluidizing end 42", which is connected to the fluidizing ring 140, and a source end 43", into which pressurized air is supplied.

Figure 10:
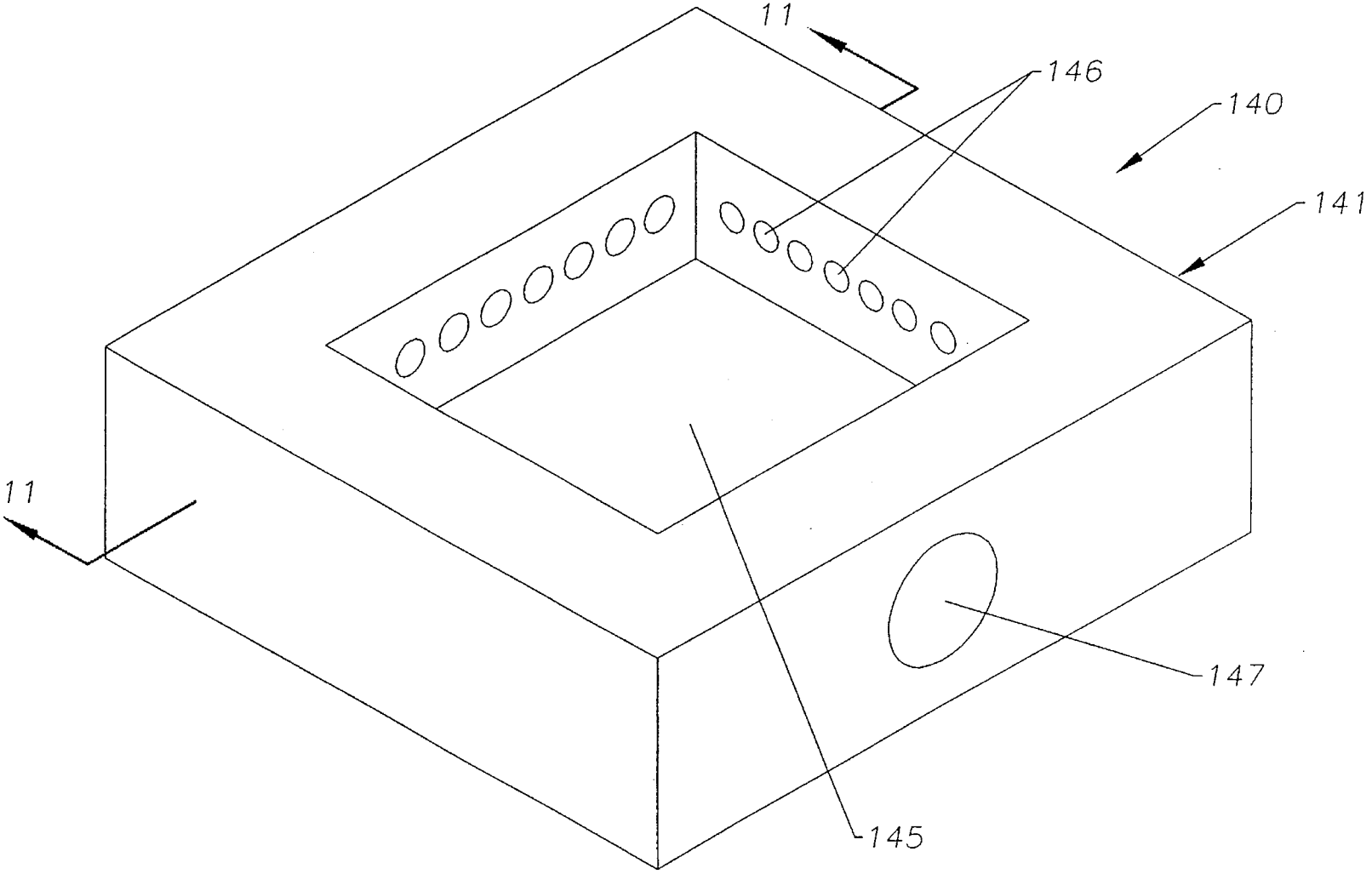
FIG. 10 is a detailed perspective view of the fluidizing ring of FIG. 9.

FIG. 10 is a detailed perspective view of the fluidizing ring 140 of FIG. 9. The fluidizing ring 140 includes a hollow ring frame 141 which defines a ring interior 142 (see FIG. 11). The fluidizing ring 140 bounds an open area 145 that is in communication with the ring interior 142 by way of a plurality of fluidizing holes 146 that are defined by the ring frame 141. Only two of the fluidizing holes are labeled in FIG. 10 for simplicity. The ring frame 141 further defines a conduit connection hole 147. The ring frame 141 is connected at the conduit connector hole 147 to the fluidizing end 42" of the fluidizer conduit 41" such that the conduit interior 44" is in communication with the ring interior 142. This connection is made in a manner that would be understood by those reasonably skilled in the industry; for example, by welding.

Figure 11:
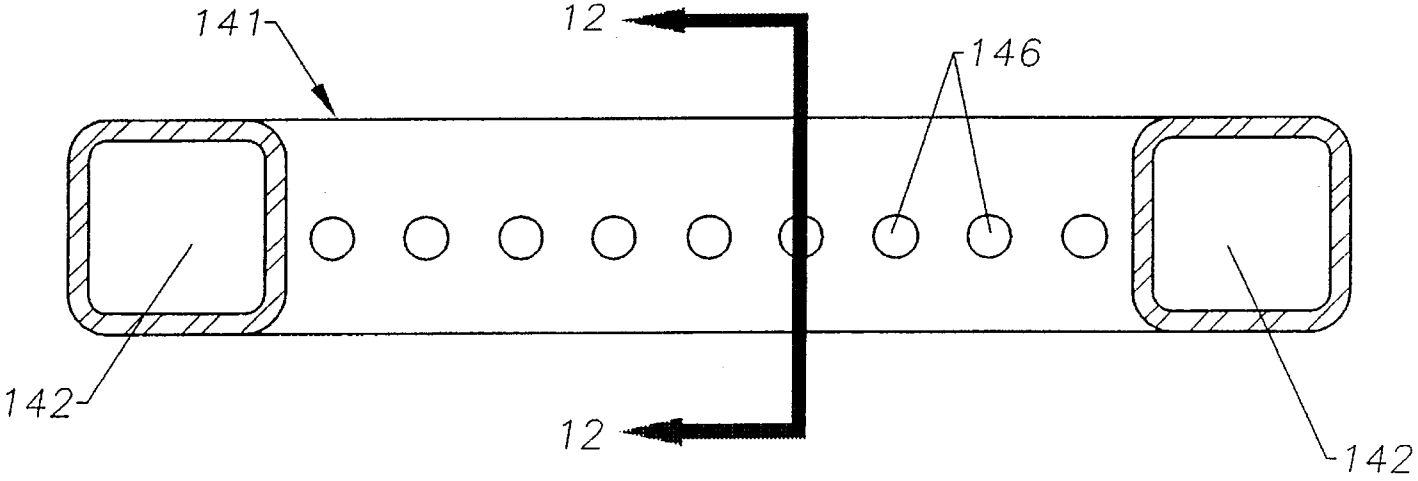
FIG. 11 is a cross-sectional view of the fluidizing ring of FIG. 9, taken along line 11—11 of FIG. 10.
Figure 12:
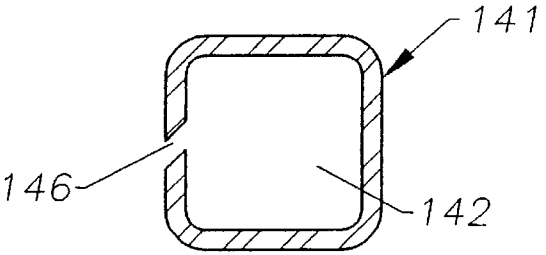
FIG. 12 is a cross-sectional view of the fluidizing ring of FIG. 9, taken along line 12—12 of FIG. 11.

FIG. 11 is a cross-sectional view taken along line 11—11 in FIG. 10. FIG. 11 shows the ring interior 142. FIG. 12 is a cross sectional view taken along line 12—12 in FIG. 11. FIG. 12 shows one of the plurality of fluidizing holes 146 defined by the ring frame 141. The fluidizing holes 146 are angled steeply enough so that portions of sand core which pass through the open area 145 defined by the ring frame 141 cannot easily migrate up, through the fluidizing holes 146, into the ring interior 142.

Figure 13:
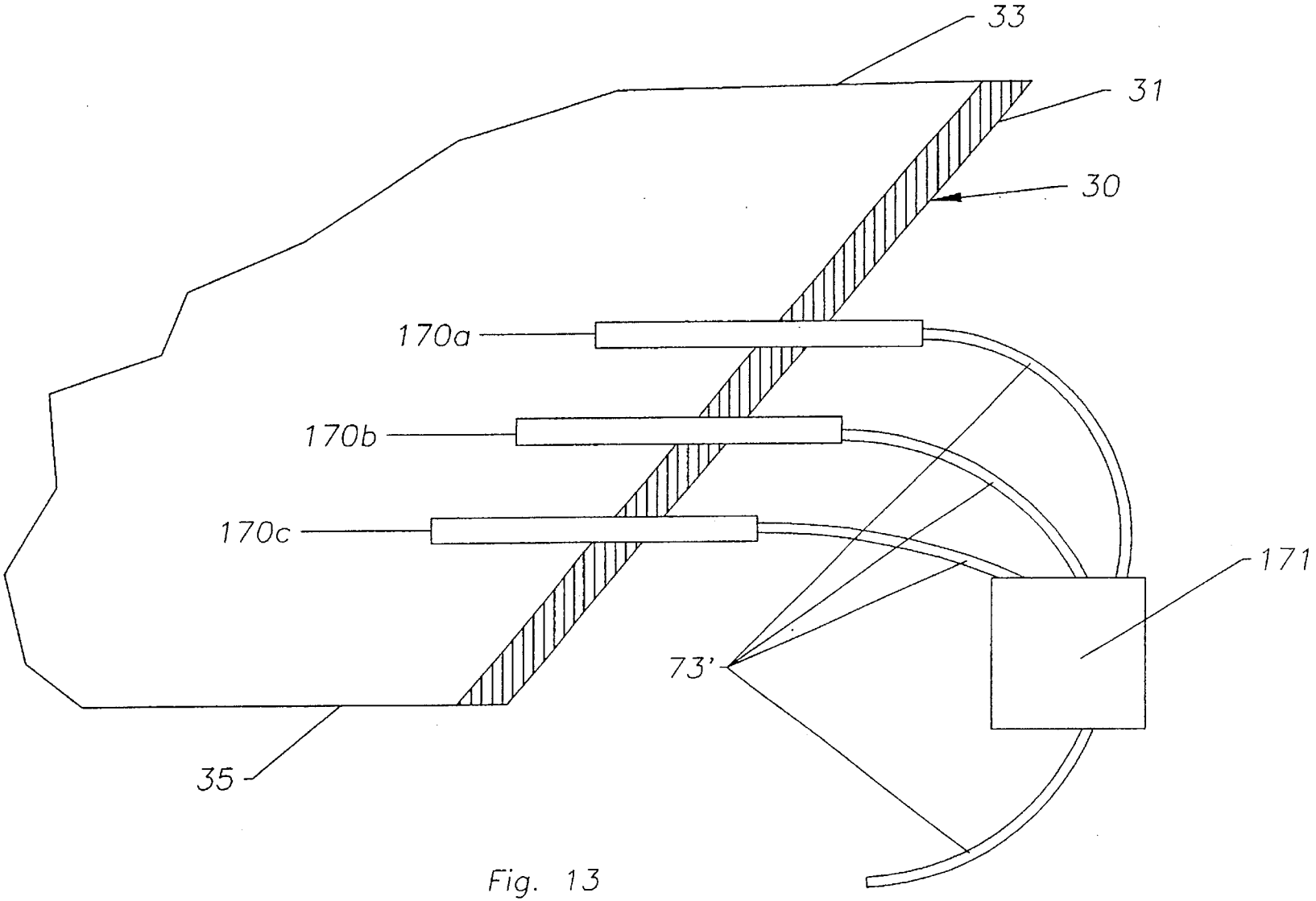
FIG. 13 is a cut-away view of a portion of an in-furnace sand reclamation unit, in accordance with an alternate embodiment of the present invention.

In an alternate embodiment of the present invention, no signal generating pressure gauge 70 is included. As shown in FIG. 13, which is a cut-away view, this alternate embodiment of the present invention includes signal generating sensors 170*a,b,c* that are mounted within the hopper 30, to the hopper wall 31. The sensors 170*a,b,c* are mounted such that they detect a predetermined level of sand core in the hopper 30. Each signal generating sensor 170*a,b,c* is connected by signal cable 73' to the discharge valve assembly 100 (not shown in FIG. 13). A selector 171 is associated with the signal generating sensors 170*a,b,c*. In the preferred embodiment of this alternate embodiment, the signal generating sensors 170*a,b,c* are electric probes.

Figure 14:
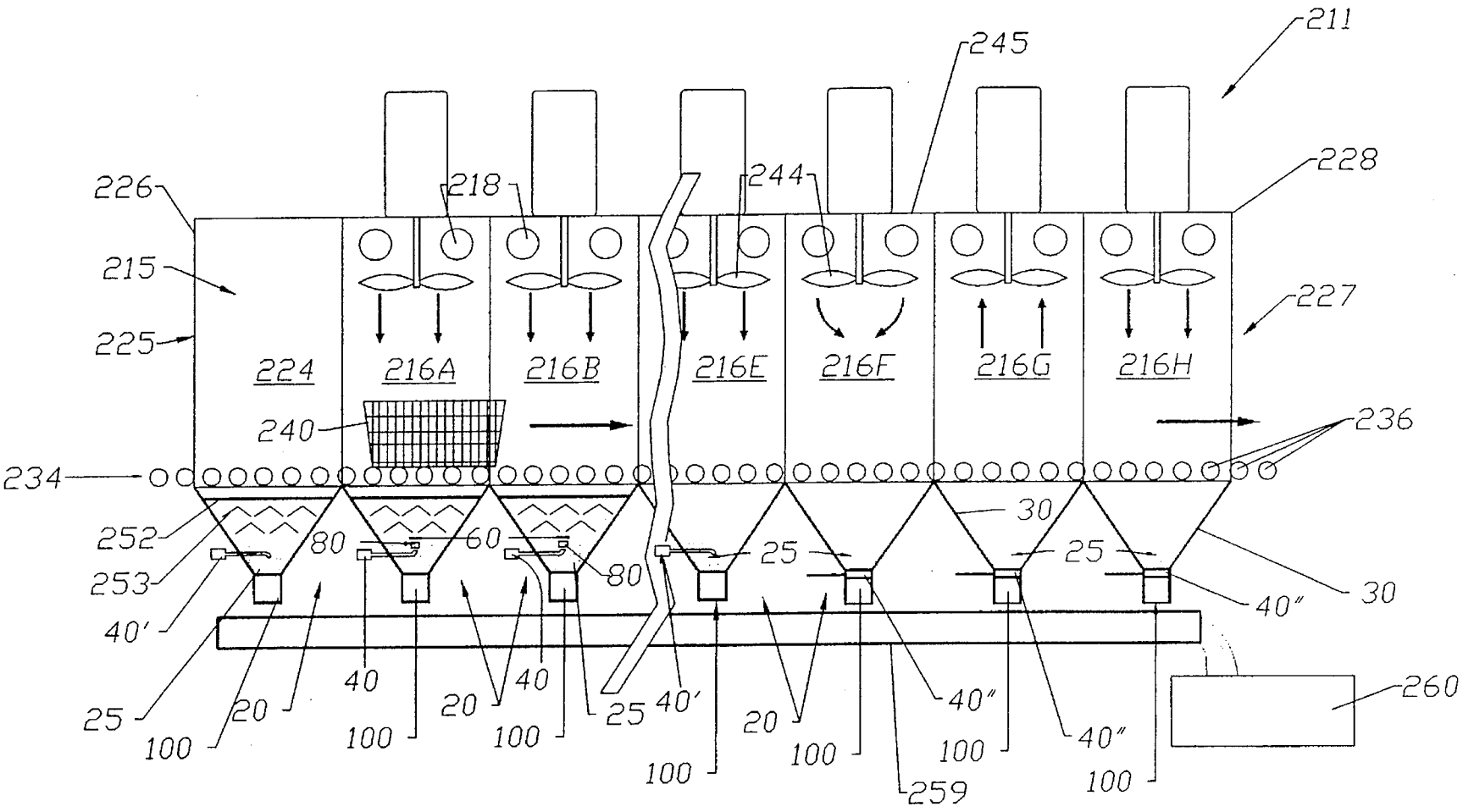
FIG. 14 is a cut-away view of a multi-zone embodiment of the heat treating furnace and in-furnace sand reclamation system, in accordance with the present invention.

FIG. 14 shows a multi-zone embodiment of the present invention, which includes a multi-zone furnace 211 employing several embodiments of the in-furnace sand reclamation unit 20. An example of furnace 211 is disclosed in U.S. Pat. No. 5,294,094. As disclosed, in FIG. 14 hereof, the furnace 211 includes: a work chamber 215; zones 216A–H; furnace heaters 218; a pre-heat chamber 224; a furnace input door 225; a furnace upper end 226; a furnace discharge door 227; a furnace lower end 228; a roller hearth 234; rollers 236; baskets 240, for transporting castings; axial fans 244; a furnace top 245; screens 252; baffles 253; a sand conveyor 259; and a central collection bin 260. For a clear understanding of the furnace 211, please refer to U.S. Pat. No. 5,294,094, which has been incorporated into this specification. The furnace 211 further includes hoppers 30 and discharge valve assemblies 100. Zones 216A,B are equipped with the fluidizer 40 (see FIGS. 1, 2, 3, and 4) guidance tube 80, and abrasion disk 60. The pre-heat chamber and Zone 216E are equipped with the fluidizer 40' (see FIGS. 6, 7, and 8), and Zones 216F,G,H are equipped with the fluidizer 40" (see FIGS. 9, 10, 11, and 12). Sand 25 is shown, in representative form, collected at the hopper outlet 35.

Figure 15:
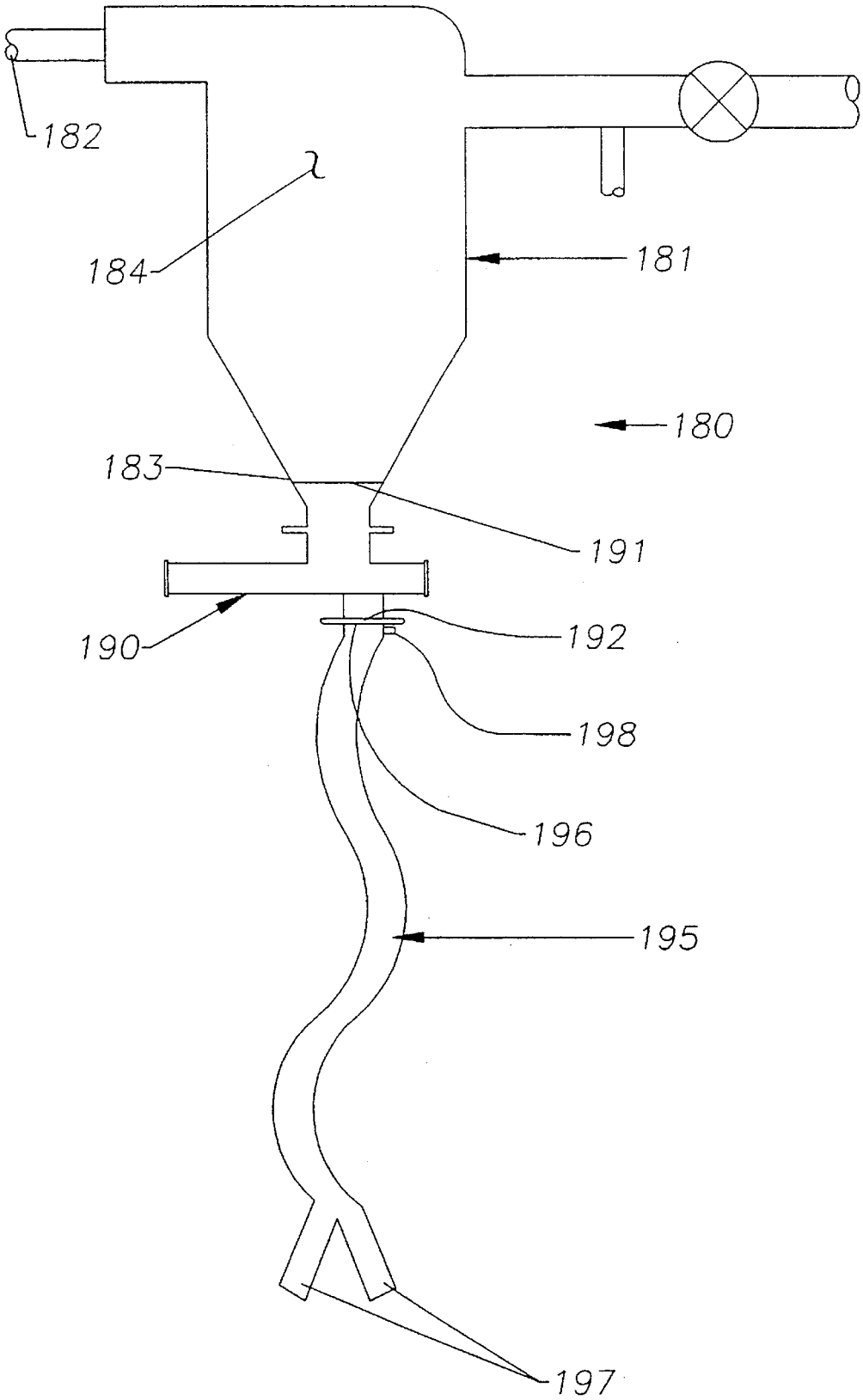
FIG. 15 is an isolated side view of a supplemental sand reclamation unit which is part of an alternate embodiment of the present invention.

FIG. 15 shows a supplemental sand reclamation unit 180 which is part of an alternate embodiment of the present invention. The supplemental sand reclaiming unit 180 includes a reclaimer hopper 181 which has a reclaimer inlet 182, a reclaimer outlet 183, and a reclaimer wall 184. The supplemental sand reclamation unit 180 further includes a discharger 190 that has a discharger inlet 191 and a discharger outlet 192. In the preferred, alternate embodiment, the discharger 190 is a screw auger. The discharger inlet 191 is connected to the hopper outlet 183 in a manner that would be understood by those reasonably skilled in the industry; for example, by welding or bolting. The supplemental sand reclamation unit 180 further includes a delivery tube 195 that defines a tube interior 199. The delivery tube 195 also has a tube inlet 196, a tube outlet 197, and an oxygen supply line 198 that is in communication with the tube interior 199. The tube inlet 196 is connected to the discharger outlet 192 in a manner that would be understood by those reasonably skilled in the industry; for example, by welding or bolting.

Figure 16:
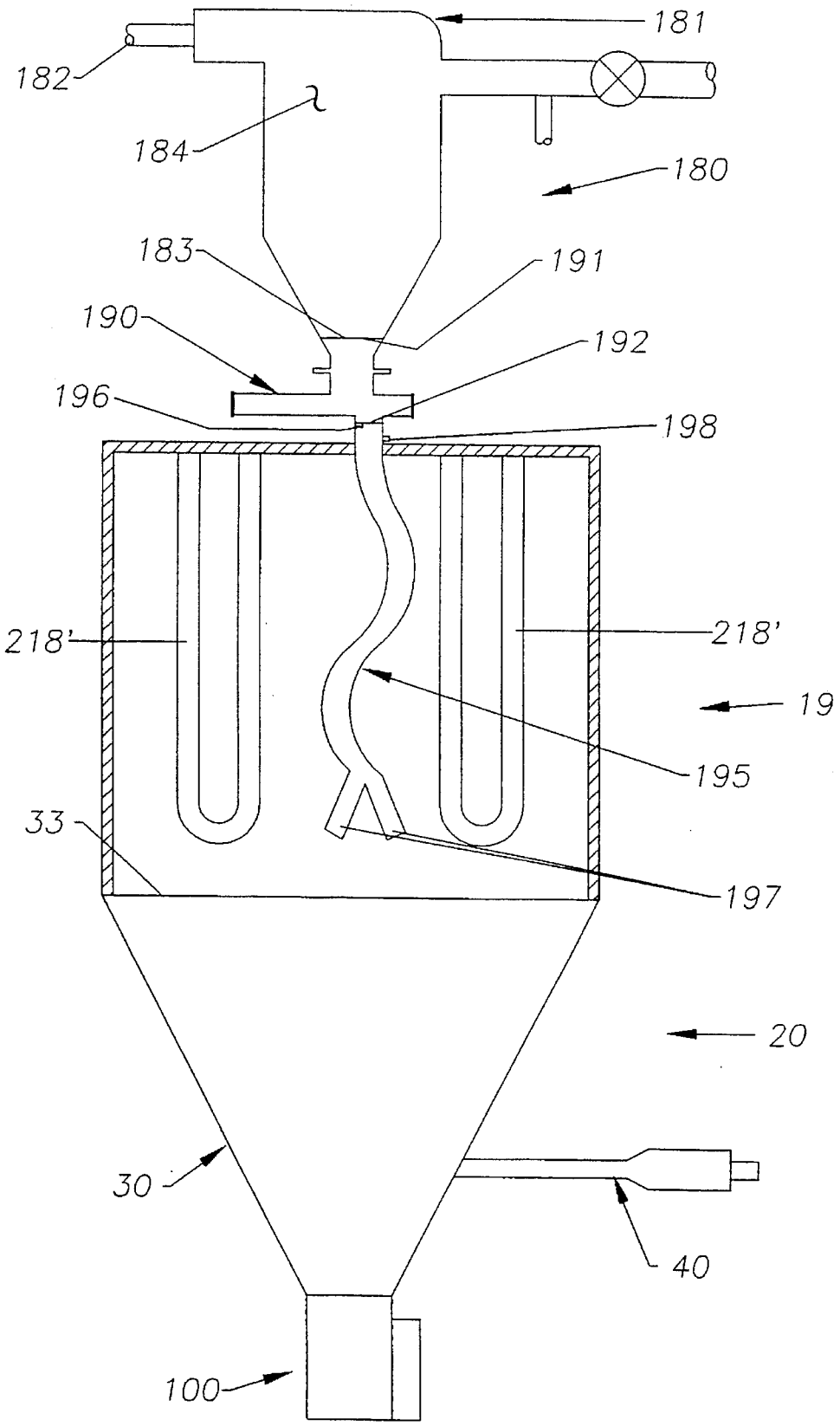
FIG. 16 is a cut-away, side view of the supplemental sand reclamation unit of FIG. 15 mounted on top of the combination heat treating furnace and in-furnace sand reclamation unit.

FIG. 16 is a cut-away view of the supplemental sand reclamation unit 180 of FIG. 15 mounted on top of the combination heat treating furnace 19 and in-furnace sand reclamation unit 20 in accordance with an alternate embodiment of the present invention. The reclaimer hopper 181 and discharger 190 are located outside of the heat treating furnace 19. The delivery tube 195 penetrates the heat treating furnace 19 and is in close proximity to u-tube furnace heaters 218'. The tube outlet 197 is oriented toward the hopper inlet 33.

Figure 17:
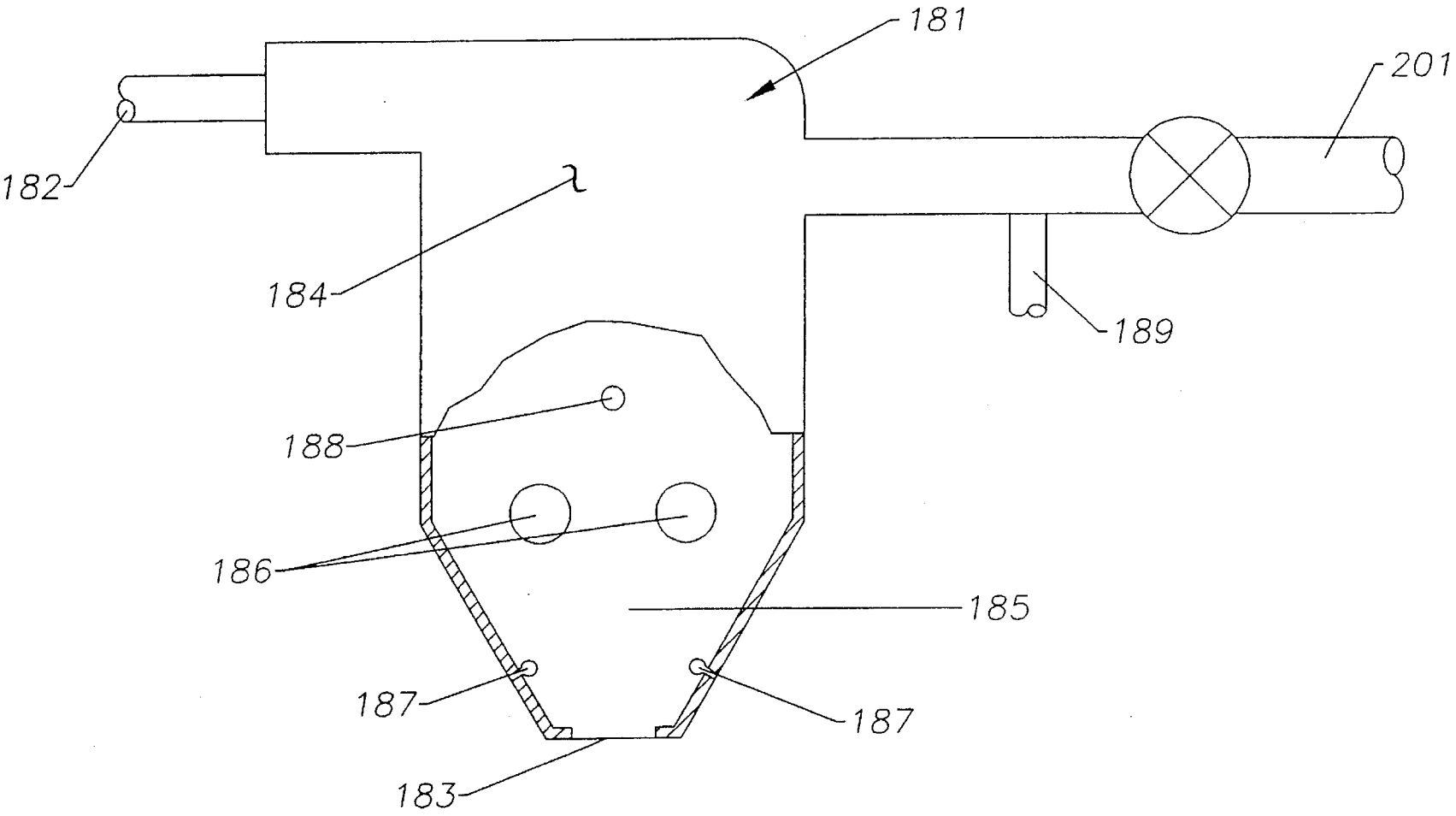
FIG. 17 is a cut-away view of the reclaimer hopper of FIG. 15.

FIG. 17 is a cut-away view of the reclaimer hopper 181 of FIG. 15. A portion of the reclaimer wall 184 is cut-away to show a reclaimer interior 185 that is defined by the reclaimer wall 184. Included within the reclaimer interior 185 are heaters 186, oxygen suppliers 187 and a level indicator 188. The reclaimer hopper 181 also includes a recycle exhaust duct 189 that exhausts into the heat treating furnace 19 and a baghouse exhaust duct 198.

OPERATION

Referring back to FIGS. 1 and 14, as the casting, with sand core attached thereto, is acted upon in accordance with the method and apparatus disclosed in U.S. Pat. No. 5,294,094, portions of sand and sand core fall through the lopper inlet 33 and sand collects within the hopper 30 toward the hopper outlet. Before a defined level of sand accumulates in the hopper 30, the first disk 116 and second disk 117 within the double dump valve 110 are maintained in contact with the first seat 118 and second seat 119, respectively. Therefore, as portions of sand and sand core continue to fall through the lopper inlet 33, the level of sand core within the hopper 30 increases.

FIGS. 1, 2, 3, and 4 disclose the first, preferred embodiment of the present invention. The equipment and process that are at the heart of the first, preferred embodiment are referred to as "high temperature fluidization with a target". In this embodiment, pressurized air is supplied through the air intake 65. Oxygenated and heated exhaust from the heater 60 discharges from the fluidizer end 42 of the fluidizer conduit 41. As the level of sand rises above the level of the fluidizer end 42, fluidization begins; the oxygenated and heated exhaust fluidizes portions of sand core that are alcove the fluidizer end 42. That is, the exhaust passes Lip through the sand, causing the sand to be suspended and act like a turbulent fluid. The fluidization further propels portions of sand through the guidance tube passage 82 where the trajectory of the entrained portions of sand is oriented toward the disk face 91 of the abrasion disk 90. Portions of sand contact the abrasion disk 90 and fall back toward the fluidizer end 42 where they are further fluidized. The portions of sand that are fluidized abrade against each other and the disk face 91. The abrasion caused by tills process knocks away ash that is adhered to the sand. This exposes unburned binder and thus promotes binder combustion. In addition to promoting binder combustion by exposing unburned binder, the fluidizer 40 promotes combustion by providing a hot and oxygenated environment. Thus, the exposed binder combusts to promote purification of the sand reclaimed from the sand core. Since the "high temperature fluidization with a target" incorporates a variety of techniques to reclaim sand (which include, at least, fluidization, fluidization in combination with an abrasion disk, heating to promote combustion, and oxygenating to promote combustion) it has a relatively high capacity as compared the processes referred to below.

Some alternate embodiments of the present invention, one of which is shown in FIGS. 6, 7, and 8, are referred to as "hot fluidization". "Hot fluidization" does not propel portions of sand core toward a target. However, "hot fluidization" is otherwise similar to "hot fluidization with a target". Pressurized air is supplied through the air intake 65. Oxygenated and heated exhaust from the heater 60 discharges from the fluidizer holes 51. As the level of sand approaches the level of the fluidizing holes 51, fluidization begins. Fluidization is promoted and enhanced by the placement and orientation of the fluidizing holes 51. The portions of sand that are fluidized abrade against each other. The abrasion caused by this process knocks away ash that is adhered to the sand. This exposes unburned binder and thus promotes binder combustion. In addition to promoting binder combustion by exposing unburned binder, the fluidizer 40' promotes combustion by providing a hot and oxygenated environment. Thus, the exposed binder combusts to promote purification of the sand reclaimed from the sand core. Since "hot fluidization" does not utilize a target, it does not typically cause as much abrasion as "lot fluidization with a target". Thus, "hot fluidization" typically exposes less binder than and therefore causes less combustion than "hot fluidization with a target". Therefore, "hot fluidization" typically has less capacity than "hot fluidization with a target". Thus, "hot fluidization with a target" is used where relatively large portions of sand and sand core fall through the hopper inlet 33 and "hot fluidization" is used where relatively moderate portions of sand and sand core fall through the hopper inlet 33.

Other alternate embodiments of the present invention, one of which is shown in FIGS. 9, 10, 11, and 12, are referred to as "cool fluidization". "Cool fluidization" is somewhat similar to "hot fluidization" except that it does not incorporate heating. Pressurized air is supplied to the source end 43" of the fluidizer conduit 41". The pressurized air passes into the ring interior 142 by way of the fluidizer end 42" of the fluidizer conduit 41" and the conduit connection hole 147. The pressurized air then escapes from the fluidizing ring 140 through the fluidizing holes 146. As the level of sand rises above the fluidizing holes 146, fluidization begins. The portions of sand that are fluidized abrade against each other. The abrasion caused by this process knocks away ash that Is adhered to the sand. This exposes unburned binder and thus promotes binder combustion. In addition to promoting binder combustion by exposing unburned binder, the fluidizer 40" promotes combustion by providing added oxygen to the environment (the heat necessary for combustion is provided by the heat treating furnace 19). Thus, the exposed binder combusts to promote purification of the sand reclaimed from the sand core. Since "cool fluidization" does not add heat to promote combustion, it does not typically cause as much combustion as "hot fluidization". Therefore, "cool fluidization" typically has less capacity than "hot fluidization". Thus, "cool fluidization" is used where relatively small portions of relatively clean sand fall through the hopper inlet 33. "Cool fluidization", in addition to reclaiming sand, cools portions of sand before they pass through the double dump valve 110. This protects the double dump valve 110 from heat related stress and strain and allows for the use of a less expensive double dump valve 110.

As specified above, the different embodiments of the present invention have different capacities. As specified in U.S. Pat. No. 5,294,094, different zones 216 (see FIG. 14) within a continuous-process furnace 211 have different capacities for loosening sand core from castings. Therefore, it is necessary to reclaim more sand in some zones 216 and less from others. In accordance with one multi-zone embodiment of the present invention, as shown in FIG. 14, higher capacity embodiments of the in-furnace sand reclamation unit 20 (for example FIGS. 1–4) are employed in high capacity zones 216A,B; moderate capacity embodiments of the in-furnace sand reclamation unit 20 (for example FIGS. 6–8) are employed in the pre-heat chamber 224 and moderate capacity zones 216E; and lower capacity embodiments of the in-furnace sand reclamation unit 20 (for example FIGS. 9–12) are employed in lower capacity zones 216F, G,H of the furnace 211. Likewise, it is preferred to employ higher capacity embodiments of the present invention in higher capacity batch-type furnaces and lower capacity embodiments of the present invention in lower capacity batch-type furnaces.

7in several embodiments of the present invention, the signal generating pressure gauge 70 and the equipment associated with it, serves to provide positive control over the level, and therefore the volume, of sand that accumulates within the hopper 30 (refer to FIGS. 2 and 9). As portions of sand continue to fall through the hopper inlet 33, the level of sand within the hopper 30 increases. As the level increases there is more resistance to the flow of air from the fluidizer end of the conduit 42 and the back-pressure in the fluidizer conduit 41 increases. The signal adjuster 74 associated with the signal generating pressure gauge 70 is set such that when a certain back-pressure is detected within the conduit interior 44 by the signal generating pressure gauge 70, a "high level" signal is generated. The pneumatic valve operator 140 receives the "high level" signal by way of the signal cable 73. While the pneumatic valve operator 140 receives the signal it operates the double dump valve 120. The double dump valve 120 is operated such that the first disk 126 and second disk 127 alternately move away from and then return to the first seat 118 and second seat 119, respectively. This operation is such that while the first disk 116 is not in contact with the first seat 118, the second disk 117 is in contact with the second seat 119, and visa-versa. Thus, while the double dump valve 110 is operating and sand is flowing from within the hopper 30 to outside of the heat treating furnace 19 by way of the double dump valve 110, back-pressure is maintained at the hopper outlet 35 such that fluidization is not disrupted. It is important that back-pressure is maintained at the hopper outlet 35 because the pressurized air that is being supplied through the fluidizer conduit 41 will take the path of least resistance. If both the first disk 116 and the second disk 117 where off of their seats, and there was a level of sand within the hopper, the path of least resistance would be through the doubled dump valve 110 to the atmosphere outside of the furnace. There fore, the pressurized air would flow through the double dump valve 110 rather than forcing its way up through the sand accumulated in the hopper. In an alternate embodiment of the present invention, the double dump valve 110 is replaced with a star valve or screw auger, or another type of device that performs a discharging and a sealing function.

In alternate embodiments of the present invention, signal generating sensors 170, mounted to the hopper wall 31 (see FIG. 13), serve to provide positive control over the level, and therefore the volume, of sand that accumulates within the hopper 30. In one embodiment the signal generating sensors 170 consist of electric capacitance probes. An electric capacitance probe is mounted to the hopper wall at each position that corresponds to a level at which it is desired to operate the double dump valve 110. The particular level at which the double dump valve will operate is established by operating the selector 171 which establishes which electric probe is controlling. As the level of sand increases and comes into contact with the controlling electric probe, a "high level" signal is generated. The pneumatic valve operator 140 receives the "high level" signal by way of the signal cable 73'. When the pneumatic valve operator 140 receives the signal it operates the double dump valve 110 as is disclosed above.

The characteristics of reclaimed sand are controlled by controlling the dwell time of portions of sand within the hopper 30. The longer the dwell time, the longer the amount of time that the portions of sand are fluidized. When portions of binder coated sand are fluidized for a relatively longer period of time, less binder is contained in the reclaimed sand but more fines are contained in the reclaimed sand. When portions of binder coated sand are fluidized for a relatively shorter period of time, more binder is contained in the reclaimed sand but less fines are contained in the reclaimed sand. The dwell time is controlled by controlling the volume of sand that is allowed to accumulate in the hopper 30. The greater the volume of sand allowed to accumulate in the hopper 30, the greater the dwell time (assuming a constant input of sand). The volume of sand that is allowed to accumulate in the hopper 30 is selected by adjusting the signal adjuster 74 in the one disclosed preferred embodiment of the present invention or by adjusting the selector 171 in the second disclosed embodiment of the present invention. In the embodiment which includes the signal generating pressure gauge 70, a larger volume of sand accumulates in the lopper 30 when the signal adjuster 74 is adjusted so that the signal generating pressure gauge 70 emits a "high level" signal at a higher pressure. A smaller volume of sand accumulates in the hopper 30 when the signal adjuster 74 is adjusted so that the signal generating pressure gauge 70 emits a "high level" signal at a lower pressure. In the embodiment which includes signal generating sensors 170 a larger or smaller volume of sand is allowed to accumulate in the hopper 30 by adjusting the selector 171 to select the signal generating sensor 170 that is mounted at the level that corresponds to the desired volume.

Referring back to FIGS. 2 and 4, the characteristics of the reclaimed sand are also controlled, in the preferred embodiment of the present invention, by adjusting the height of the abrasion disk 90 above the fluidizer end 42 of the fluidizer conduit 41. The height is adjusted by loosening the turnbuckles 98, unhooking the hook ends 97 from the eyehooks 99, hooking the hook ends 97 to the appropriate eyehooks 99, and tightening the turnbuckles 98. These components can be accessed by entering the hopper 30 through the furnace 19 or through trap doors in the hopper wall 31. Generally, when the height of the abrasion disk 90 is decreased more abrasion occurs because propelled portions of sand impact the abrasion disk 90 with more force; therefore, less binder is contained in the reclaimed sand and more fines are contained in the reclaimed sand. Generally, when the height is increased less abrasion occurs because propelled portions of sand impact the abrasion disk 90 with less force; therefore, more binder is contained in the reclaimed sand and less fines are contained in the reclaimed sand.

Referring back to FIGS. 15–17, the supplemental sand reclamation unit 180 is used, in conjunction with the fluidizer 40 and other components in the heat treating furnace 19, to further purify sand that has already been reclaimed by some other process, and to reclaim sand from portions of sand core initially reclaimed by another process. The portions of sand core and coated sand that are introduced into the supplemental sand reclamation unit 180 are not adhered to castings. For example only, if a core was accidently molded into the wrong shape such that it could not be used for casting, it could be crushed and the portions thereof could be introduced into the supplemental sand reclamation unit 180. Portions of sand core and coated sand are introduced into the supplemental sand reclamation unit 180 through the reclaimer inlet 182. The heaters 186 and oxygen suppliers 187 maintain an atmosphere within the reclaimer interior 185 that causes some of the binder associated with the introduced sand and portions of sand core to combust such that sand is reclaimed within the reclaimer hopper 181. The reclaimed sand is transferred from the reclaimer hopper 181 to the delivery tube 195 by the discharger 190. The sand within the delivery tube 195 is drawn by gravity from the tube inlet 196 toward the tube outlet 197. The sand in the delivery tube 195 is lea ted due to the fact that the delivery tube 195 is in close proximity to u-tube furnace heaters 218'. The sand in the delivery tube 195 is also exposed to oxygen that is supplied through the oxygen supply line 198. Therefore, at least some exposed binder that passes through the delivery tube 195 is combusted. As sand passes from the tube outlet 197 it falls into the hopper 30 where it is further purified by fluidization, as is discussed above.

The embodiments of the present invention can be constructed from a variety of materials and include a variety of components. The following is offered for example only. The hopper 30, guidance tube 80, and abrasion disk could be made out of various abrasion resistant alloys. More specifically, the hopper 30 and guidance tube 80 could be made out of 4130, 4140 or 1020 steel, and the abrasion disk 90 could be made out of a cast high manganese alloy. The fluidizing ring 140 could be constructed of A36 structural steel square tubing. The high pressure burner, which serves as the heater 60 in one embodiment of the present invention, could be an Eclipse brand. The signal generating pressure gauge 70 could be a Dwyer brand photoelectric gauge. The electric capacitance probes, that serve as the signal generating sensors 170 in one embodiment of the present invention, and the level indicator 188 could be an Endress Hauser brand, LSC 1110 Series capacitance probe. A low voltage is applied to these probes, and when the probe comes into contact with some material (for example sand) current flows into the material and the probe senses the current flow. The double dump valve 110 could be a Ni-Hard and nickel chrome alloy high temperature double dump valve made by Plattco Corporation. The Fluidizer conduit 41 can be constructed from stainless steel. The heater 186 could be a National brand silicon carbide heating element.

Whereas this invention has been described in detail with particular reference to preferred embodiments and alternate embodiments thereof, it will be understood that variations and modifications can be effected within the spirit and scope of the invention, as described herein before and as defined in the appended claims.

We claim:

1. A method for heat treating a casting having a sand core and reclaiming sand from the sand core, the sand core comprising sand particles bound together by a binder material, the sand core defining a cavity within the casting, and the method comprising steps of:

introducing the casting, with at least a portion of the sand core therein, into a furnace;

heating the furnace to a temperature in excess of the combustion temperature of the binder material;

containing the casting, with the at least a portion of the sand core therein, within the heated furnace;

combusting binder material of at least a portion of the sand core disposed within the casting, whereby portions of the sand core are loosened and fall from the cavity of the casting while the casting is within the furnace;

collecting the portions of the sand core which fall from the casting;

fluidizing the collected portions of the sand core within a flow of air such that sand is at least partially reclaimed from the collected portions of the sand core, wherein the flow of air is directed into the furnace, and wherein the flow of air is oxygenated and contributes to the creation of an oxygenated atmosphere within the furnace, which oxygenated atmosphere facilitates, at least in part, the combusting step; and conveying the at least partially reclaimed sand away from the furnace.

2. The method of claim 1, wherein the collecting step and the fluidizing step are carried out within the furnace.

3. The method of claim 1, wherein the flow of air is cool, and wherein the method further comprises a step of cooling the at least partially reclaimed sand with the flow of air.

4. The method of claim 1, further comprising a step of heating the flow of air to above the combustion temperature of the binder material whereby the fluidizing step includes a steps of combusting binder material of the fluidized portions of the sand core, and whereby the fluidizing step contributes to the heating of the furnace.

5. The method of claim 1, wherein the step of fluidizing includes steps of exposing the collected portions of the sand core to an oxygenated atmosphere, and heating the collected portions of the sand core to above the combustion temperature of the binder, whereby binder material of the collected portions of the sand core is combusted.

6. The method of claim 5, further comprising a step of regulating the duration of the fluidizing step so that the amount of fines and the amount of binder material that are included with the at least partially reclaimed sand conveyed away from the furnace are selectively controlled, wherein the regulating step includes steps of measuring the amount of the collected portions of the sand core, and discharging, in response to the measuring step, at least a portion of the at least partially reclaimed sand, wherein the at least partially reclaimed sand that has been discharged is no longer subjected to the fluidizing step, and wherein the at least partially reclaimed sand that has been discharged is subjected to the conveying step.

7. The method of claim 5, wherein the step of fluidizing causes the collected portions of the sand core to be suspended and act like a turbulent fluid.

8. The method of claim 7, wherein the step of fluidizing further includes a step of abrading combustion by-products off of the collected portions of the sand core, whereby binder material combustion is enhanced.

9. The method of claim 1, wherein the collecting step includes a step collecting the fallen portions of the sand core to define a bed of the collected portions of the sand core, and wherein the fluidizing step includes a step of fluidizing the bed of the collected portions of the sand core.

10. The method of claim 9, wherein the step of fluidizing further includes a step of heating the bed of the collected portions of the sand core to above the combustion temperature of the binder, whereby binder material of the bed of the collected portions of the sand core is combusted.

11. The method of claim 9, wherein the collecting step and the fluidizing step are carried out within the furnace.

12. A method for heat treating a casting having a sand core and reclaiming sand from the sand core, the sand core comprising sand particles bound together by a binder material, the sand core defining a cavity within the casting, and the method comprising steps of:

introducing the casting, with at least a portion of the sand core therein, into a furnace system, wherein the furnace system defines a heat treating region, and a reclaiming region disposed below the heat treating region and in heat and gaseous communication with the heat treating region, wherein the furnace system includes a support assembly for supporting the casting within the heat treating region, and wherein the introducing step includes a step of placing the casting upon the support assembly;

heat treating the casting while the casting is disposed within the heat treating region;

dislodging portions of the sand core from the casting while the casting is disposed within the heat treating region, wherein the dislodging step includes a step of combusting binder material of the portion of the sand core;

causing the dislodged portions of the sand core to fall from the casting and the support assembly into the reclaiming region;

reclaiming, at least partially and within the reclaiming region, sand from the fallen portions of the sand core, wherein the reclaiming step includes steps of further combusting binder material of the fallen portions of the sand core, and agitating the fallen portions of sand core in a manner that facilitates the step of further combusting; and conveying the reclaimed sand away from the furnace system, thereby accomplishing heat treatment, core removal, and at least partial sand reclamation in an integrated process associated with a single furnace system.

13. The method of claim 12, wherein the heat treating region and the reclaiming region are both disposed within a single furnace.

14. The method of claim 12, wherein the agitating step includes a step of fluidizing the fallen portions of the sand core.

15. The method of claim 12, wherein the method further comprises a step of maintaining the released sand core portions in a heated state during the time between the dislodging step and the reclaiming step.

16. The method of claim 12, wherein the step of reclaiming is carried out prior to any activity intended to substantially cool the dislodged portions of the sand core.

17. The method of claim 12, wherein the heat treating region and the reclaiming region are vertically aligned.

18. The method of claim 12, wherein the dislodged portions of the sand core free fall from casting and the support assembly into the reclaiming region.

19. The method of claim 12, wherein the reclaiming step further includes steps of collecting the fallen portions of the sand core within the reclaiming region to define a bed of fallen portion of the sand core, fluidizing the bed of the fallen portions of the sand core, wherein the fluidizing step includes the mentioned step of agitating the fallen portions.

20. The method of claim 19, wherein the step of reclaiming is carried out prior to any activity intended to substantially cool the dislodged portions of the sand core, and wherein the heat treating region and the reclaiming region are both disposed within a single furnace.

21. The method of claim 12, wherein the combusting step of the dislodging step includes a step of exposing the casting and at least a portion of the sand core therein to an oxygenated and heated atmosphere, and wherein the reclaiming step further includes a step of suspending, within the oxygenated and heated atmosphere, at least some of the fallen portions of the sand core in a manner that facilitates the step of further combusting binder material of the fallen portions of the sand core.

22. The method of claim 21, wherein the suspending step includes a step of fluidizing at least some of the fallen portions of the sand core.

23. The method of claim 21, wherein the suspending step includes steps of providing a screen disposed beneath the casting and the support assembly, suspending on the screen fallen portions of the sand core which are larger than apertures defined by the screen, to allow further combustion of binder material therefrom, and releasing the suspended portions of the sand core subsequent to the combustion of binder material therefrom.

24. The method of claim 21, wherein the suspending step includes steps of providing a screen disposed beneath the casting and the support assembly, suspending on the screen fallen portions of the sand core which are larger than apertures defined by the screen, to allow further combustion of binder material therefrom, releasing the portions of the sand core suspended upon the screen subsequent to the combustion of binder material therefrom, and fluidizing the released portions of the sand core, wherein the fluidizing step includes the mentioned step of agitating the fallen portions.

25. The method of claim 12, wherein the further combusting step of the reclaiming step includes a step of suspending, within an oxygenated and heated atmosphere, at least some of the fallen portions of the sand core such that binder material is combusted from the suspended portions of the sand core, and wherein the combusting step of the dislodging step includes a step of exposing the casting and at least a portion of the sand core therein to the oxygenated and heated atmosphere.

26. The method of claim 25, wherein the suspending step includes a step of fluidizing at least some of the fallen portions of the sand core.

27. The method of claim 25, wherein the suspending step includes steps of providing a screen disposed beneath the casting and the support assembly, suspending on the screen fallen portions of the sand core which are larger than apertures defined by the screen, to allow further combustion of binder material therefrom, and releasing the suspended portions of the sand core subsequent to the combustion of binder material therefrom.

28. The method of claim 25, wherein the suspending step includes steps of providing a screen disposed beneath the casting and the support assembly, suspending on the screen fallen portions of the sand core which are larger than apertures defined by the screen, to allow further combustion of binder material therefrom, releasing the portions of the sand core suspended upon the screen subsequent to the combustion of binder material therefrom, and fluidizing the released portions of the sand core, wherein the fluidizing step includes the mentioned step of agitating the fallen portions.

29. The method of claim 12, wherein the further combusting step of the reclaiming step includes a step of suspending, within an oxygenated atmosphere, at least some of the portions of the sand core which have fallen from the casting and the support assembly such that binder material is combusted from the suspended portions of the sand core.

30. The method of claim 27, wherein the suspending step includes a step of fluidizing at least some of the fallen portions of the sand core.

31. The method of claim 29, wherein the suspending step includes steps of providing a screen disposed beneath the casting and the support assembly, suspending on the screen fallen portions of the sand core which are larger than apertures defined by the screen, to allow further combustion of binder material therefrom, and releasing the suspended portions of the sand core subsequent to the combustion of binder material therefrom.

32. The method of claim 29, wherein the suspending step includes steps of providing a screen disposed beneath the casting and the support assembly, suspending on the screen fallen portions of the sand core which are larger than apertures defined by the screen, to allow further combustion of binder material therefrom, releasing the portions of the sand core suspended upon the screen subsequent to the combustion of binder material therefore; and fluidizing the released portions of the sand core, wherein the fluidizing step includes the mentioned step of agitating the fallen portions.

33. The method of claim 29, wherein the heat treating region and the reclaiming region are both disposed within a single furnace.

34. The method of claim 29, wherein the step of suspending is carried out prior to any activity that substantially cools the released sand core portions.

35. The method of claim 29, wherein the combusting step of the dislodging step includes a step of exposing the casting and at least a portion of the sand core therein to the oxygenated atmosphere.

36. The method of claim 29, wherein the support assembly includes a roller hearth assembly, wherein the introducing step includes steps of placing the casting into a basket, and placing the basket, with the casting therein, upon the roller hearth assembly, and wherein the dislodged portions of the sand core fall from the casting, the basket, and the roller hearth assembly prior to the suspending step.

37. A method for heat treating a casting having a sand core and reclaiming sand from the sand core, the sand core comprising sand particles bound together by a binder material, the sand core defining a cavity within the casting, and the method comprising steps of:

providing an oxygenated atmosphere;

heating the oxygenated atmosphere to a temperature in excess of the combustion temperature of the binder material;

introducing the casting, with at least a portion of the sand core therein, into a furnace, wherein the furnace includes a support assembly for supporting the casting within the furnace, wherein the introducing step includes a step of placing the casting upon the support assembly, wherein the casting is exposed within the furnace to the oxygenated and heated atmosphere to permit binder material to combust, and wherein portions of the sand core are loosened from and fall from the cavity of the casting and the support assembly while the casting is within the furnace;

collecting, distant from the casting and the support assembly, the portions of the sand core which fall from the support assembly prior to the binder material being combusted therefrom;

maintaining the collected portions of the sand core within the oxygenated atmosphere in a manner that permits binder material to be combusted therefrom such that sand is at least partially reclaimed from the collected portions of the sand core; and conveying the at least partially reclaimed sand away from the furnace.

38. The method of claim 37, wherein the maintaining step includes a step of agitating the collected portions of the sand core within the oxygenated atmosphere in a manner that promotes the combustion of binder material therefrom.

39. The method of claim 38, wherein the maintaining step further includes a step of suspending the collected portions of the sand core within the oxygenated atmosphere in a manner that promotes the combustion of binder material therefrom.

40. The method of claim 39, wherein the suspending step includes steps of providing a screen disposed beneath the casting and the support assembly, suspending on the screen fallen portions of the sand core which are larger than apertures defined by the screen, to allow further combustion of binder material therefrom, and releasing the suspended portions of the sand core subsequent to the combustion of binder material therefrom.

41. The method of claim 39, wherein the steps of suspending and agitating are carried out within the furnace.

42. The method of claim 39, wherein the steps of suspending and agitating comprise a step of fluidizing the collected portions of the sand core within the oxygenated atmosphere in a manner that promotes the combustion of binder material therefrom.

43. The method of claim 42, wherein the suspending step further includes steps of providing a screen disposed beneath the casting and the support assembly, suspending on the screen fallen portions of the sand core which are larger than apertures defined by the screen, to allow further combustion of binder material therefrom, and releasing the suspended portions of the sand core subsequent to the combustion of binder material therefrom.

44. The method of claim 42, wherein the step of fluidizing the collected portions of the sand core is carried out within the furnace.

45. The method of claim 42, wherein the furnace defines a plurality of zones that are spatially displaced from one another, and wherein the method further comprises a step of conveying the casting along a path through the plurality of zones.

46. A method for heat treating a casting having a sand core and reclaiming sand from the sand core, the sand core comprising sand particles bound together by a binder material, the sand core defining a cavity within the casting, and the method comprising steps of:

introducing the casting, with at least a portion of the sand core therein, into a furnace;

heating the furnace to a temperature in excess of the combustion temperature of the binder material;

containing the casting, with the at least a portion of the sand core therein, within the heated furnace;

combusting binder material of at least a portion of the sand core disposed within the casting, whereby portions of the sand core are loosened and fall from the cavity of the casting while the casting is within the furnace;

collecting the portions of the sand core which fall from the casting;

fluidizing the collected portions of the sand core within a flow of heated gas such that sand is at least partially reclaimed from the collected portions of the sand core, wherein the flow of heated gas is directed into the furnace, and wherein the flow of heated gas contributes to the heating of the furnace; and conveying the at least partially reclaimed sand away from the furnace.

47. The method of claim 46, wherein the flow of heated gas is oxygenated and contributes to the creation of an oxygenated atmosphere within the furnace, which oxygenated atmosphere facilitates, at least in part, the combusting step.

48. The method of claim 46, wherein the step of fluidizing the collected portions of the sand core is carried out within the furnace.

49. A method for heat treating a casting having a sand core and reclaiming sand from the sand core, the sand core comprising sand particles bound together by a binder material, the sand core defining a cavity within the casting, and the method comprising steps of:

introducing a casting with at least some sand core therein into a furnace, wherein the furnace includes a support assembly for supporting the casting within the furnace, and wherein the introducing step includes a step of placing the casting upon the support assembly;

heating the furnace to a temperature sufficient to heat treat the casting and sufficient to combust the binder material of the sand core;

burning binder material of the sand core within the furnace to release sand core portions from the casting, wherein the released sand core portions fall from the cavity of the casting and the support assembly while the casting is within the furnace;

reclaiming, at a reclaiming region distant from the casting and the support assembly, at least some sand from portions of the fallen sand core portions, which reclaiming is accomplished through additional burning of binder material of portions of the fallen sand core portions, and wherein the reclaiming region and the furnace are proximately located such that heat passes between the reclaiming region and the furnace; and thereafter conveying sand and any attached binder material away from the furnace.

50. The method of claim 49, wherein the reclaiming step includes steps of agitating and exposing the portions of the fallen sand core portions to an oxygenated atmosphere in a manner that facilitates additional burning of binder material of portions of the fallen sand core portions.

51. The method of claim 50, wherein gasses are transferred between the reclaiming region and the furnace.

52. The method of claim 50, wherein the method further comprises a step of maintaining the larger portions of the released sand core portions in a heated state during the time between the step of burning binder material and the step of reclaiming.

53. The method of claim 50, wherein the step of reclaiming is carried out prior to any activity intended to substantially cool the released sand core portions.

54. The method of claim 50, wherein the step of introducing the casting into the furnace is performed prior to any mechanical shaking intended to remove meaningful portions of the sand core, whereby mechanical shaking for core removal is avoided.

55. The method of claim 50, wherein the reclaiming region is below the support assembly such that the released sand core potions fall, under the force of gravity, from the support assembly to the reclaiming region.

56. The method of claim 55, wherein the reclaiming region is disposed within the furnace.

57. The method of claim 49, wherein the reclaiming step includes a step of fluidizing the fallen sand core portions in a manner that facilitates the additional burning of binder material from the released sand core portions.

58. The method of claim 57, wherein the reclaiming step further includes a step of collecting a bed of the fallen sand core portions, and wherein the fluidizing step includes a step of fluidizing the bed of the fallen sand core portions.

59. The method of claim 58, wherein the collecting step and the fluidizing step are carried out within the furnace.

60. The method of claim 57, wherein the step of fluidizing includes steps of heating the fallen sand core portions, and exposing the fallen sand core portions to an oxygenated atmosphere, whereby binder material of the fallen sand core portions is combusted.

61. The method of claim 57, wherein the step of fluidizing contributes to the heating of the furnace.

62. The method of claim 57, further comprising a step of controlling the duration of the fluidizing so that the amount of fines and the amount of binder material that are included with the sand conveyed away from the furnace are controlled, wherein the regulating step includes steps of measuring the amount of the fallen sand core portions, and discharging, in response to the measuring step, at least a portion of the sand from the reclaiming region, wherein the sand that has been discharged is no longer subjected to the fluidizing step, and wherein the sand that has been discharged is subjected to the conveying step.

63. A method for heat treating a casting having a sand core and reclaiming sand from the sand core, the sand core comprising sand particles bound together by a binder material, the sand core defining a cavity within the casting, and the method comprising steps of:

introducing the casting, with at least a portion of the sand core therein, into a furnace;

heating the furnace to a temperature in excess of the combustion temperature of the binder material;

providing an oxygenated atmosphere within the furnace;

containing the casting, with the at least a portion of the sand core therein, within the oxygenated atmosphere in the heated furnace to permit binder material to combust, whereby portions of the sand core are loosened and fall from the cavity of the casting while the casting is within the furnace;

collecting the portions of the sand core which fall from the casting prior to the binder material being combusted therefrom to form a bed of loosened portions of sand core;

fluidizing the bed of loosened portions of sand core such that sand is at least partially reclaimed from the bed of loosened portions of sand core, the fluidizing step including a step of burning binder material from the bed of loosened portions of sand core, whereby fumes are generated;

capturing and at least partially incinerating the fumes within the furnace; and conveying the at least partially reclaimed sand away from the furnace.

64. The method of claim 63, further comprising a step of controlling the duration of the fluidizing so that the amount of fines and the amount of binder material that are included with the at least partially reclaimed sand are selectively controlled, wherein the regulating step includes steps of measuring the amount of the collected portions of the sand core that make up the bed of loosened portions of the sand core, and discharging, in response to the measuring step, at least a portion the at least partially reclaimed sand from the bed of loosened portions of the sand core, wherein the at least partially reclaimed sand that has been discharged is no longer subjected to the fluidizing step, and wherein the at least partially reclaimed sand that has been discharged is subjected to the conveying step.

65. The method of claim 63, wherein the collecting step is carried out within the furnace such that the bed of loosened portions of sand core is defined within the furnace, and wherein the fluidizing is carried out within the furnace.

66. The method of claim 63, wherein the step of fluidizing further includes steps of heating the bed of loosened portions of sand core to above the combustion temperature of the binder, and exposing the bed of loosened portions of sand core to an oxygenated atmosphere, whereby binder material of the bed of loosened portions of sand core is combusted.

67. The method of claim 66, wherein the step of fluidizing at least partially oxygenates the atmosphere within the furnace.

68. The method of claim 66, wherein the step of fluidizing at least partially heats the furnace.

69. A furnace system for heat treating a casting having a sand core and reclaiming sand from the sand core, the sand core comprising sand particles bound together by a binder material, the sand core defining a cavity within the casting, and the furnace system comprising:

a heat treating region for receiving the casting therewithin;

a support assembly for supporting the casting within the heat treating region; and a heating means for heating said heat treating region to a temperature sufficient to loosen portions of the sand core from the casting while the casting is in said heat treating region;

a reclaiming region disposed below said heat treating region and in heat and gaseous communication with said heat treating region, wherein the loosened portions of the sand core fall under the force of gravity from the casting and said support assembly into said reclaiming region; and a fluidizer for fluidizing and reclaiming sand from the fallen portions of the sand core disposed within said reclaiming region.

70. The furnace system of claim 69, further comprising a conveyer downstream from said reclaiming region for conveying the reclaimed sand away from the reclaiming region.

71. The furnace system of claim 69, wherein the furnace system further comprises a furnace, wherein said heat treating region and said reclaiming region are both disposed within said furnace, and wherein said fluidizer is constructed and arranged to define and fluidize, within said furnace, a bed of the fallen portions of the sand core.

72. The furnace system of claim 69, wherein said heat treating region and said reclaiming region are vertically aligned.

73. The furnace system of claim 72, wherein said furnace system further defines a vertically extending passage between said heat treating region and said reclaiming region, wherein said passage allows the loosened portions of the sand core to fall substantially vertically from said heat treating region to said reclaiming region, and wherein said passage facilitates said gaseous and heat communication.

74. The furnace system of claim 79, wherein the furnace system further comprises a hopper defining a hopper interior and including a hopper inlet that is oriented such that the loosened portions of the sand core fall into said hopper inlet and into said hopper interior, and a hopper outlet defining an opening below said hopper inlet, wherein said hopper outlet is constructed and arranged to pass the fallen portions of the sand core from said hopper interior, and wherein said fluidizer is proximate to said hopper outlet.

75. The furnace system of claim 74, wherein said fluidizer is connected to said hopper proximate to said hopper outlet.

76. The furnace system of claim 75, wherein said fluidizer is directly connected to said hopper outlet.

77. The furnace system of claim 75, wherein the furnace system further comprises a furnace, and wherein said hopper is at least partially disposed within said furnace and said hopper outlet is further constructed and arranged to pass the fallen portions of the sand core from the furnace.

78. The furnace system of claim 77, wherein said heat treating region and said reclaiming region are vertically aligned.

79. The furnace system of claim 78, wherein said furnace system further defines a vertically extending passage between said heat treating region and said reclaiming region, wherein said passage allows the loosened portions of the sand core to fall substantially vertically from said heat treating region to said reclaiming region, and wherein said passage facilitates said gaseous and heat communication.

80. The furnace system of claim 74, wherein said fluidizer includes a source of pressurized gas, and a fluidizer conduit which defines a hollow conduit interior, wherein said fluidizer conduit extends from a first end that is in communication with said source of pressurized gas and terminates at a second end in a manner that causes fluidization of the fallen portions of the sand core.

81. The furnace system of claim 80, wherein said fluidizer further includes a heater for heating the fallen portions of the sand core to a temperature above the combustion temperature of the binder material of the fallen portions of the sand core, and wherein said source of pressurized gas includes a source of oxygen, whereby binder material of the fallen portions of the sand core is combusted.

82. The furnace system of claim 80, wherein said fluidizer further includes a fluidizing ring connected to said second end of said fluidizer conduit, wherein said fluidizing ring includes a ring frame at least partially bounding a central open area and defining, a hollow ring interior in communication with the conduit interior of said fluidizer conduit, and a plurality of fluidizing portals communicating between the central open area and the ring interior.

83. The furnace system of claim 82, wherein said fluidizing ring is disposed such that fallen portions of the sand core pass from said hopper outlet and through said central open area defined by said ring frame, and wherein said fluidizing portals are angled steeply enough so that fallen portions of the sand core which pass through the central open area cannot easily migrate up, through the fluidizing portals into the ring interior.

84. The furnace system of claim 80, wherein said fluidizer is constructed and arranged to fluidize the fallen portions of the sand core within said hopper interior.

85. The furnace system of claim 84, wherein the furnace system further comprises a furnace, wherein said heat treating region is disposed within said furnace, and a level means for controlling the level of fallen portions of the sand core within said hopper interior, said level means including a measurement means for determining the amount of fallen portions of the sand core within said hopper interior, and a signal means for generating a signal when said measurement means determines that a first amount of fallen portions of the sand core is within said hopper interior, and a discharge means for discharging reclaimed sand from said furnace, wherein said discharge means is responsive to said signal of said signal means to effect discharge of fallen portions of the sand core, and wherein during said discharge, fallen portions of the sand core pass from said hopper interior and are discharged from said furnace through said hopper outlet, and wherein the amount of fallen portions of the sand core that collect within said hopper interior is controlled by said level means and said discharge means such that the length of time that fallen portions of the sand core remain in said hopper interior and are subjected to said fluidizer is controlled, whereby the amount of binder material and fines contained with the reclaimed sand discharged from said furnace is controlled.

86. The furnace system of claim 85, wherein said fluidizer interacts with the fallen portions of the sand core within said hopper interior to define a back-pressure in said conduit interior of said fluidizer conduit, wherein the back-pressure increases as the depth of the fallen portions of the sand core within said hopper interior increases, wherein said measurement means includes a gauge in communication with said conduit interior for determining the back-pressure, and wherein said signal means generates a signal when the back-pressure reaches a first level, whereby a specified amount of fallen portions of the sand core is maintained within said hopper interior.

87. The furnace system of claim 86, wherein said signal means includes a signal adjustment means for selectively specifying the back-pressure at which said signal means generates said signal, whereby the amount of fallen portions of the sand core that collect within said hopper interior is selectively controlled, whereby the length of time that fallen portions of the sand core remain in said hopper interior and are subjected to said fluidizer is selectively controlled, whereby the amount of binder material and fines contained with the reclaimed sand discharged from said furnace is selectively controlled.

88. The furnace system of claim 85, wherein said measurement means includes a sensor disposed at a height above said hopper outlet, wherein said signal means generates a signal when the fallen portions of the sand core in said hopper interior define a level of fallen portions of the sand core that is at or above said height of said sensor.

89. Furnace system of claim 85, wherein said measurement means includes a plurality of sensors, wherein each sensor of said plurality of sensors is disposed at a different one of a plurality of different heights above said hopper outlet, wherein each of said plurality of different heights corresponds to a desired amount of fallen portions of the sand core in said hopper interior, and said signal means further includes selector means for selectively specifying one sensor of said plurality of sensors as controlling, wherein, as the level of fallen portions of the sand core in said hopper interior rises to the height of said sensor of said plurality of sensors that is controlling, said signal means generates said signal, whereby the amount of fallen portions of the sand core that collect within said hopper interior is selectively controlled.

* * * * *